US007726897B2

(12) United States Patent
To et al.

(10) Patent No.: US 7,726,897 B2
(45) Date of Patent: Jun. 1, 2010

(54) RING BINDER MECHANISM

(75) Inventors: Chun Yuen To, Hong Kong (CN); Chun Hai Lin, Zhang Zhou (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 603 days.

(21) Appl. No.: 11/675,493

(22) Filed: Feb. 15, 2007

(65) Prior Publication Data

US 2007/0160415 A1 Jul. 12, 2007

Related U.S. Application Data

(63) Continuation-in-part of application No. 11/190,328, filed on Jul. 27, 2005.

(60) Provisional application No. 60/664,125, filed on Mar. 22, 2005.

(51) Int. Cl.
*B42F 13/20* (2006.01)

(52) U.S. Cl. ..... 402/29; 402/80 R

(58) Field of Classification Search ..... 402/19, 402/20, 26, 29, 37–39, 41, 70, 73, 80 R, 80 P, 402/500; D19/26, 27
See application file for complete search history.

(56) References Cited

U.S. PATENT DOCUMENTS 566,717 A 8/1896 Krah
651,254 A 6/1900 Krah
683,019 A 9/1901 Buchanan
790,382 A 5/1905 McBride
854,074 A 5/1907 Bryant
857,377 A 6/1907 Baker
974,831 A 11/1910 Scherzinger (Continued)

FOREIGN PATENT DOCUMENTS

DE 10119121 A1 10/2001

(Continued)

OTHER PUBLICATIONS

Nov. 2, 2007 Office Action and references cited by Examiner in related U.S. Appl. No. 11/190,328, 11 pages.

(Continued)

*Primary Examiner*—Dana Ross
*Assistant Examiner*—Pradeep C Battula
(74) *Attorney, Agent, or Firm*—Senniger Powers LLP

(57) ABSTRACT

A ring mechanism having a housing and at least one ring configurable between a closed position for retaining loose-leaf pages and an open position. A pair of hinge plates, operatively connected to the ring, are pivotable within the housing between first and second position corresponding respectively to the closed and open positions of the ring. Each hinge plate has a free end and a line of weakness formed therein proximate the free end to facilitate bending of the hinge plate. A hinge plate actuator has a bearing surface engageable with the hinge plates proximate the free ends thereof upon movement of the actuator from a first position toward a second position thereof such that the hinge plates bend proximate their free ends to delay pivoting movement of the hinge plates upon initial movement of the actuator from its first position toward its second position.

21 Claims, 41 Drawing Sheets

U.S. PATENT DOCUMENTS

| | | | |
|---|---|---|---|
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,733,548 | A | 10/1929 | Martin |
| 1,733,894 | A | 10/1929 | Martin |
| 1,787,957 | A | 1/1931 | Schade |
| 1,822,669 | A | 9/1931 | Schade |
| 1,857,291 | A | 5/1932 | Trussell |
| 1,953,981 | A | 4/1934 | Trussell |
| 1,991,362 | A | 2/1935 | Krag |
| 1,996,463 | A | 4/1935 | Dawson |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,089,211 | A | 8/1937 | Krag |
| 2,096,944 | A | 10/1937 | Unger |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis |
| 2,251,878 | A | 8/1941 | Hanna |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil |
| 2,552,076 | A | 5/1951 | Wedge |
| 2,612,169 | A | 9/1952 | Segal |
| 2,789,561 | A | 4/1957 | Bonn |
| 2,865,377 | A | 12/1958 | Schroer |
| 2,871,711 | A | 2/1959 | Stark |
| 2,891,553 | A | 6/1959 | Acton |
| 2,894,513 | A | 7/1959 | Gempe |
| 2,950,719 | A | 8/1960 | Lyon |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf |
| 3,718,402 | A | 2/1973 | Schade |
| 3,748,051 | A | 7/1973 | Frank |
| 3,884,586 | A | 5/1975 | Michaelis |
| 3,954,343 | A | 5/1976 | Thomsen |
| 3,993,374 | A | 11/1976 | Schudy |
| 4,127,340 | A | 11/1978 | Almgren |
| 4,130,368 | A | 12/1978 | Jacoby |
| 4,352,582 | A | 10/1982 | Eliasson |
| 4,486,112 | A | 12/1984 | Cummins |
| 4,522,526 | A | 6/1985 | Lozfau |
| 4,566,817 | A | 1/1986 | Barrett, Jr. |
| 4,571,108 | A | 2/1986 | Vogl |
| 4,696,595 | A | 9/1987 | Pinkney |
| 4,798,491 | A | 1/1989 | Lassle |
| 4,813,803 | A * | 3/1989 | Gross ..... 402/38 |
| 4,815,882 | A | 3/1989 | Ohminato |
| 4,886,390 | A | 12/1989 | Silence |
| 4,919,557 | A | 4/1990 | Podosek |
| 5,067,840 | A | 11/1991 | Cooper |
| 5,116,157 | A | 5/1992 | Gillum |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin |
| 5,476,335 | A | 12/1995 | Whaley |
| 5,524,997 | A | 6/1996 | von Rohrscheidt |
| 5,577,852 | A | 11/1996 | To |
| 5,634,666 | A | 6/1997 | Lee |
| 5,651,628 | A | 7/1997 | Bankes |
| 5,660,490 | A | 8/1997 | Warrington |
| 5,692,847 | A | 12/1997 | Zane |
| 5,692,848 | A | 12/1997 | Wada |
| 5,718,529 | A | 2/1998 | Chan |
| 5,782,569 | A | 7/1998 | Mullin |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,904,435 | A | 5/1999 | Tung |
| 5,924,811 | A | 7/1999 | To |
| 5,957,611 | A | 9/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder |
| 6,293,722 | B1 | 9/2001 | Holbrook |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,270,496 | B2 | 9/2007 | Morgan |
| 7,296,946 | B2 | 11/2007 | Cheng |
| 2003/0103797 | A1 | 6/2003 | Cheng |
| 2003/0103798 | A1 | 6/2003 | Cheng |
| 2003/0123923 | A1 | 7/2003 | Koike |
| 2005/0013654 | A1 | 1/2005 | Cheng |
| 2005/0201817 | A1 | 9/2005 | Cheng |
| 2005/0201818 | A1 | 9/2005 | Cheng |
| 2005/0201819 | A1 | 9/2005 | Cheng |
| 2005/0201820 | A1 | 9/2005 | Ng |
| 2005/0207826 | A1 | 9/2005 | Cheng |

| | | | |
|---|---|---|---|
| 2005/0214064 | A1 | 9/2005 | Ng |
| 2005/0232689 | A1 | 10/2005 | Cheng |
| 2006/0008318 | A1 | 1/2006 | Ng |
| 2006/0056906 | A1 | 3/2006 | Horn |
| 2006/0088365 | A1 | 4/2006 | Whaley |
| 2006/0147253 | A1 | 7/2006 | Cheng |
| 2006/0147254 | A1 | 7/2006 | Cheng |
| 2006/0147255 | A1 | 7/2006 | Cheng |
| 2006/0153628 | A1 | 7/2006 | Tanaka |
| 2006/0153629 | A1 | 7/2006 | Cheng |
| 2006/0216107 | A1 | 9/2006 | Lin |
| 2006/0228164 | A1 | 10/2006 | Horn |
| 2006/0251467 | A1 | 11/2006 | Cheng |
| 2006/0251468 | A1 | 11/2006 | Cheng |
| 2007/0086836 | A1 | 4/2007 | Cheng |

FOREIGN PATENT DOCUMENTS

| | | | |
|---|---|---|---|
| EP | 1316438 | A1 | 6/2003 |
| EP | 1323545 | A2 | 7/2003 |
| EP | 1431065 | A2 | 6/2004 |
| FR | 1336765 | | 9/1963 |
| FR | 1346864 | | 12/1963 |
| FR | 2221924 | | 10/1974 |
| FR | 22221924 | | 10/1974 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 5979379 | | 5/1984 |
| JP | 6118880 | | 2/1986 |
| JP | 01299095 | A | 12/1989 |
| JP | 1299095 | A1 | 12/1989 |
| JP | 2034289 | U | 3/1990 |
| JP | 4120085 | | 10/1992 |
| JP | 2004098417 | A | 4/2004 |
| WO | 0119620 | A1 | 3/2001 |
| WO | 0181099 | A1 | 11/2001 |

OTHER PUBLICATIONS

Office action dated Feb. 2, 2009 from related U.S. Appl. No. 11/562,261, 10 pgs.
European Search Report for related EP application 07 11 2573 dated Aug. 6, 2008, 2 pgs.
Response filed Apr. 14, 2009 to Office action dated Feb. 2, 2009 in related U.S. Appl. No. 11/562,261, 11 pgs.
Response filed Apr. 3, 2009 to Office action dated Dec. 4, 2008 in related U.S. Appl. No. 11/190,328, 22 pgs.
Kokuyo Lock Ring Mechanism with description, two instruction sheets, and nine photographs, undated but admitted as prior art, 12 pgs.
Office Action dated Nov. 2, 2007 from related U.S. Appl. No. 11/190,328, 11 pgs.
Office Action dated Jun. 3, 2008 from related U.S. Appl. No. 11/190,328, 16 pgs.
Office action issued Jul. 1, 2009 in related U.S. Appl. No. 11/190,328, 12 pages.
Office action issued Jul. 1, 2009 in related U.S. Appl. No. 11/562,261, 8 pages.
European Search Report for EP 07 11 2573 dated July 10, 2008, 2 pgs.
Response filed Feb. 28, 2008 to Office action dated Nov. 2, 2007 from related U.S. Appl. No. 11/190,328, 18 pgs.
Response filed Sep. 2, 2008 to Office action dated Jun. 3, 2008 from related U.S. Appl. No. 11/190,328, 25 pgs.
Office action dated Dec. 4, 2008 from related U.S. Appl. No. 11/190,328, 11 pgs.
Response filed Sep. 8, 2009 to Office Action dated Jul. 1, 2009 regarding U.S. Appl. No. 11/190,328, 15 pgs.
Response filed Sep. 8, 2009 to Office Action dated Jul. 1, 2009 regarding U.S. Appl. No. 11/562,261, 5 pgs.
Advisory Action issued Sep. 22, 2009 from related U.S. Appl. No. 11/562,261, 4 pgs.
Response filed Nov. 2, 2009 to Advisory Action dated Sep. 22, 2009 from related U.S. Appl. No. 11/562,261, 9 pgs.

* cited by examiner

RING BINDER MECHANISM

CROSS-REFERENCE

This application is a continuation-in-part of U.S. patent application Ser. No. 11/190,328, filed Jul. 27, 2005, which claims priority to provisional Patent Application No. 60/664,125, filed Mar. 22, 2005.

BACKGROUND

This invention relates generally to ring binder mechanisms (broadly referred to herein as a ring mechanism) for retaining loose-leaf pages, and in particular to such a ring mechanism capable of opening and closing mating ring members and locking the ring members when closed.

A ring mechanism is typically used to retain loose-leaf pages, such as hole-punched pages, in a file or notebook. Ring mechanisms commonly have mating ring members that may be selectively opened to add or remove pages, or closed together to retain pages while allowing the pages to be moved along the ring members. The ring members mount on two adjacent (e.g., side-by-side) hinge plates that join together along a hinge line to form a pivot axis about which the plates may pivot. An elongate, resilient housing loosely supports the hinge plates within the housing and holds the hinge plates together so they may pivot relative to the housing.

The housing is slightly narrower than the joined hinge plates when the hinge plates are in a coplanar position (180°). In this manner, as the hinge plates pivot through their coplanar position, they deform the resilient housing and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. Levers or other actuating systems may also be provided on one or both ends of the housing for moving the ring members between the open and closed positions. In some ring mechanisms, however, when the ring members are closed they do not positively lock in their closed position. As a result, if the mechanism is accidentally dropped, the ring members may unintentionally open.

To this end, some ring mechanisms have been modified to include locking structure to block the hinge plates from pivoting when the ring members are closed. The locking structure positively locks the closed ring members together, preventing them from unintentionally opening if the ring mechanism is accidentally dropped. The locking structure also allows the housing spring force to be reduced because the strong spring force is not required to clamp the closed ring members together. Thus, less operator force is required to open and close the ring members than in traditional ring mechanisms.

Some of these ring mechanisms incorporate the locking structure onto a control slide connected to the lever. The lever moves the control slide (and its locking structure) to either block the pivoting movement of the hinge plates or allow it. However, an operator must positively move the lever after closing the ring members to position the locking structure to block the hinge plates and lock the ring members closed. Failure to do this could allow the hinge plates to inadvertently pivot and open the ring members, especially if the mechanisms are accidentally dropped.

Other locking ring mechanisms use springs to move the locking structure into position blocking the hinge plates when the ring members close. Examples are shown in co-owned U.S. patent application Ser. Nos. 10/870,801 (Cheng et al.), Ser. No. 10/905,606 (Cheng), and Ser. No. 11/027,550 (Cheng). These mechanisms employ separate springs to help lock the mechanisms.

Accordingly, there is a need for a simple ring binder mechanism that readily locks ring members together when the mechanism is closed without requiring additional spring components to do so.

Moreover, the configuration of some locking ring binder mechanisms is such that the control slide can bind when the mechanism is being operated, which makes it difficult to open the rings of the mechanism. Accordingly, there is also a need for ring binder mechanisms in which such binding of the control slide is avoided.

SUMMARY

In one embodiment, a ring mechanism for holding loose-leaf pages generally comprises a housing and at least one ring for holding the loose-leaf pages. Each ring comprises a first ring member and a second ring member, with the ring members being configurable between a closed position and an open position. In the closed position the ring members form a substantially continuous closed loop for allowing loose-leaf pages retained by the ring to be moved along the ring from one ring member to the other, and in the open position the two ring members form a discontinuous, open loop for adding or removing loose-leaf pages from the ring. A hinge mechanism is operatively connected to the ring members for configuring the ring members between their open and closed position. The hinge mechanism generally comprises a pair of elongate hinge plates supported within the housing for pivoting movement relative to the housing between a first hinge plate position corresponding to the closed position of the ring members and a second hinge plate position corresponding to the open position of the ring members. Each of the hinge plates has a free end and a line weakness formed therein proximate the free end to facilitate bending of the hinge plate. An actuator is moveable between a first position corresponding to the closed position of the ring members and a second position corresponding to the open position of the ring members. The actuator generally comprises a bearing surface engageable with the hinge plates proximate the free ends thereof upon movement of the actuator from its first position toward its second position such that the hinge plates bend proximate their free ends to delay pivoting movement of the hinge plates upon initial movement of the actuator from its first position toward its second position.

In another embodiment, a ring mechanism for holding loose-leaf pages generally comprises a housing and at least one ring for holding the loose-leaf pages. Each ring generally comprises a first ring member and a second ring member, with the ring members being configurable between a closed position and an open position. In the closed position the ring members form a substantially continuous closed loop for allowing loose-leaf pages retained by the ring to be moved along the ring from one ring member to the other, and in the open position the two ring members form a discontinuous, open loop for adding or removing loose-leaf pages from the ring. A hinge mechanism is operatively connected to the ring members for configuring the ring members between their open and closed position. The hinge mechanism generally comprises a pair of elongate hinge plates supported within the housing for pivoting movement relative to the housing between a first hinge plate position corresponding to the closed position of the ring members and a second hinge plate position corresponding to the open position of the ring members. Each hinge plate has a free end and is configured to have a first width, a second width narrower than the first width and nearer to the free end of the hinge plate than the first width, and a third width greater than the second width and nearer to the free end of the hinge plate than the second width to facilitate bending of the hinge plate generally at the second width. An actuator, moveable between a first position corresponding to the closed position of the ring members and a second position corresponding to the open position of the ring members, generally comprises a bearing surface engageable with the hinge plates proximate the free ends thereof upon movement of the actuator from its first position toward its second position such that the hinge plates bend proximate their free ends generally at the second width to delay pivoting movement of the hinge plates upon initial movement of the actuator from its first position toward its second position.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
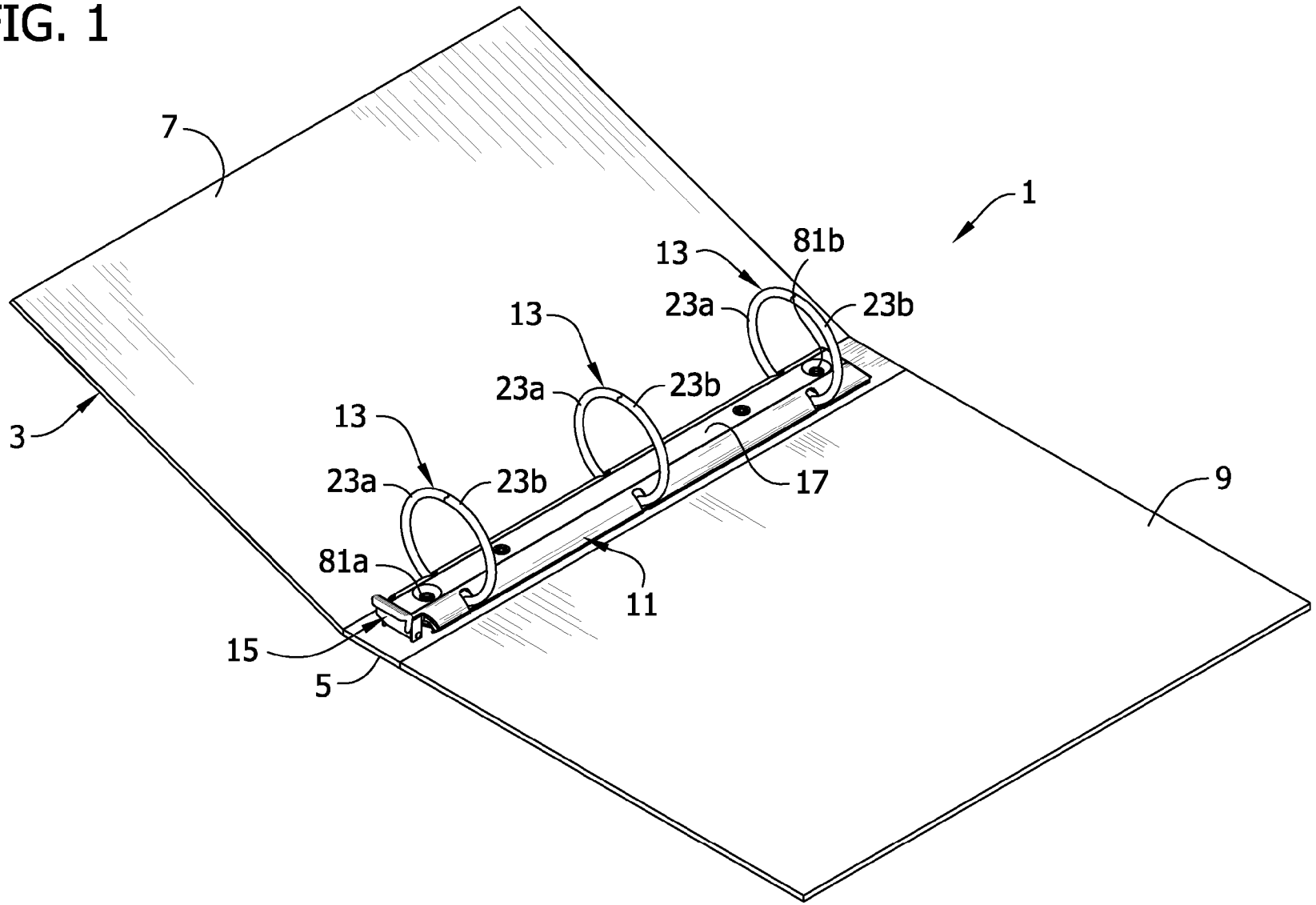
FIG. 1 is a perspective of a notebook incorporating a ring binder mechanism according to a first embodiment of the invention.

Referring now to the drawings, FIGS. 1-13 show a ring mechanism according to a first embodiment generally at 1. In FIG. 1, the ring mechanism 1 is shown mounted on a notebook designated generally at 3. Specifically, the ring mechanism 1 is shown mounted on a spine 5 of the notebook 3 between a front cover 7 and a back cover 9 hingedly attached to the spine 3. The front and back covers 7, 9 move to selectively cover or expose loose-leaf pages (not shown) retained by the ring mechanism 1 in the notebook 3. Ring mechanisms mounted on surfaces other than a notebook, for example, a file, do not depart from the scope of this invention.

Figure 2:
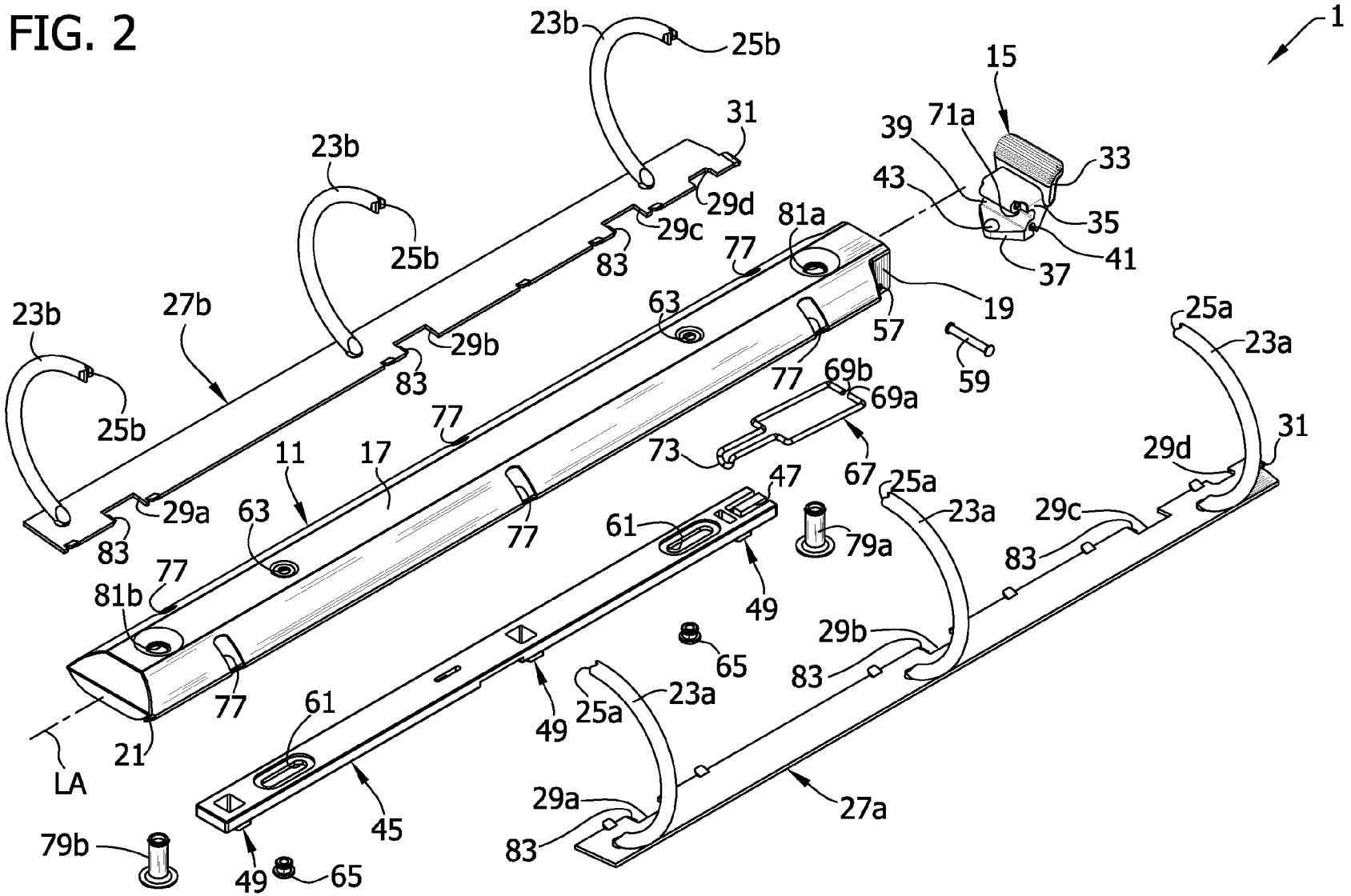
FIG. 2 is an exploded perspective of the ring mechanism.

As shown in FIG. 1, a housing, designated generally at 11, supports three rings (each designated generally at 13) and a lever (broadly, an "actuator," and designated generally at 15). The rings 13 retain loose-leaf pages on the ring mechanism 1 in the notebook 3 while the lever 15 operates to open and close the rings so that pages may be added or removed. Referring now also to FIG. 2, the housing 11 is shaped as an elongate rectangle with a uniform, roughly arch-shaped cross section, having at its center a generally flat plateau 17. A first longitudinal end of the housing 11 (to the left in FIG. 1 and to the right in FIG. 2) is generally open while a second, opposite longitudinal end is generally closed. A pair of mounting arms, each designated 19 (FIGS. 2 and 4), extend downward from the housing plateau 17 at the open end, while bent under rims, each designated at 21 (FIGS. 2 and 5), extend lengthwise along longitudinal edges of the housing 11 from the first longitudinal end of the housing to the second longitudinal end. Mechanisms having housings of other shapes, including irregular shapes, or housings that are formed integrally with a file or notebook do not depart from the scope of this invention.

Figure 4:
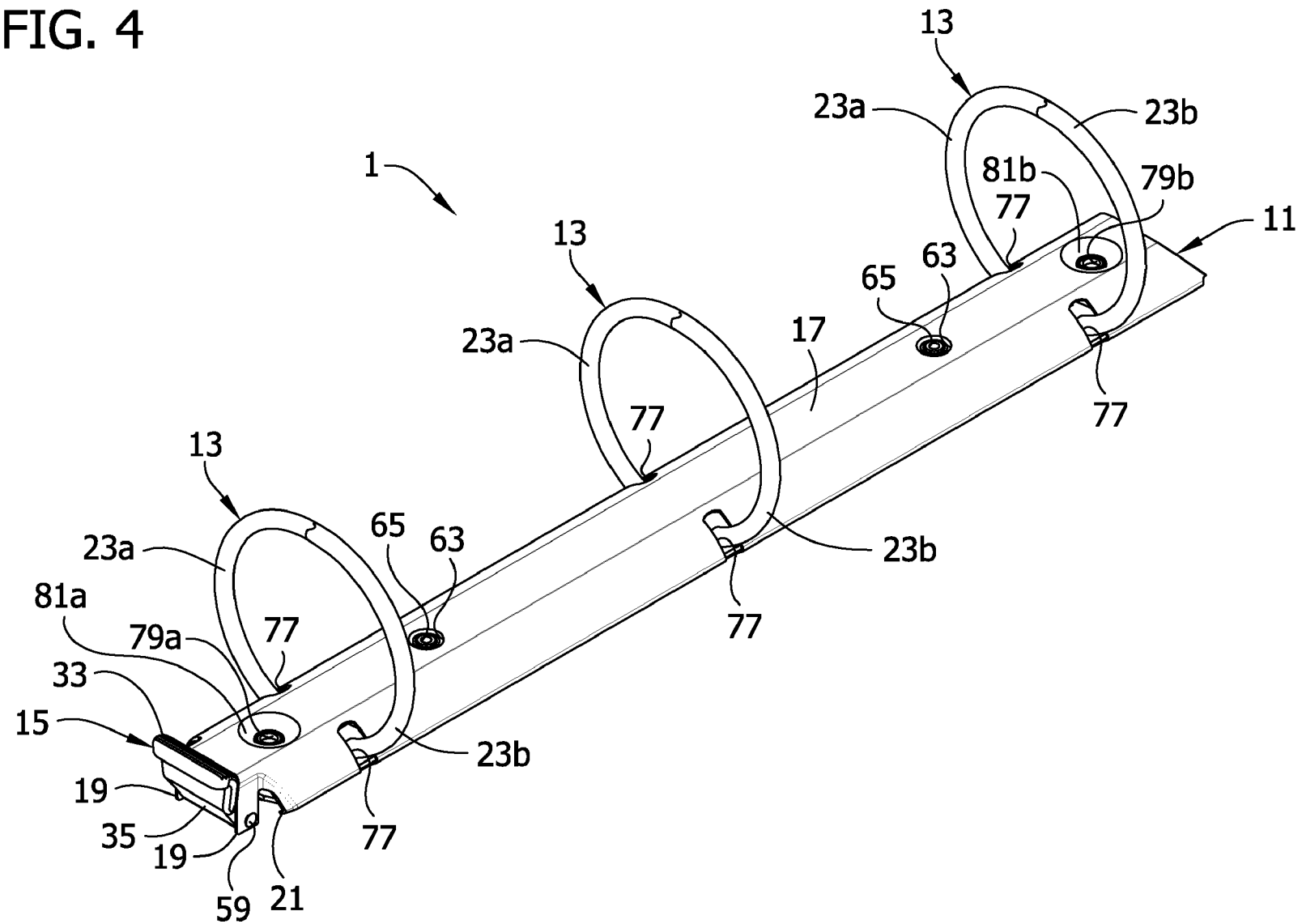
FIG. 4 is a top side perspective of the ring mechanism at a closed and locked position with the lever in a first relaxed position.
Figure 5:
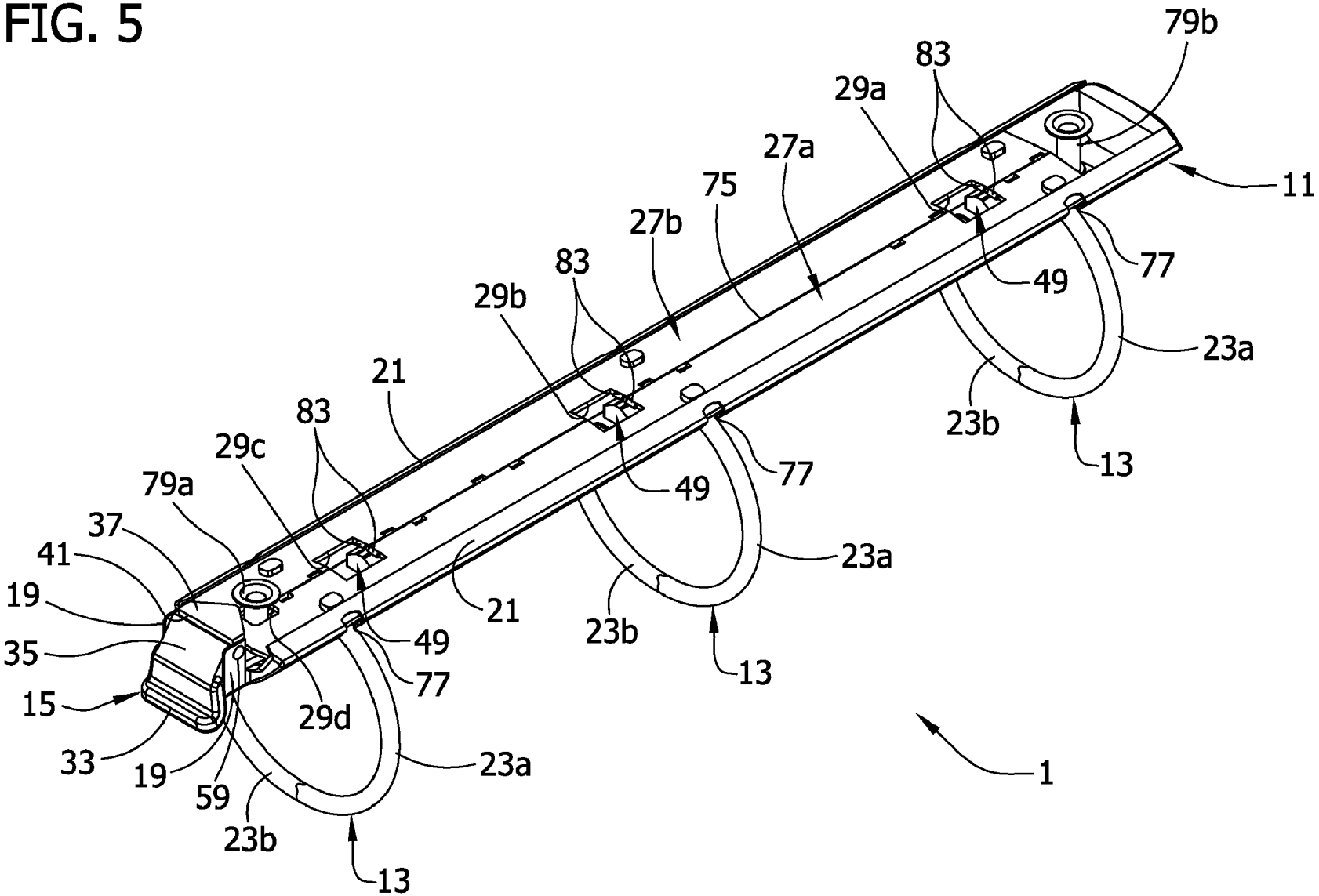
FIG. 5 is a bottom side perspective thereof.

The three rings 13 of the ring mechanism 1 are substantially similar and are each generally circular in shape (FIGS. 1, 4, and 5). As shown in FIGS. 1 and 2, the rings 13 each include two generally semi-circular ring members 23*a*, 23*b* formed from a conventional, cylindrical rod of a suitable material (e.g., steel). The ring members 23*a*, 23*b* include free ends 25*a*, 25*b*, respectively, formed to secure the ring members against transverse misalignment (relative to longitudinal axes of the ring members) when they are together (e.g., FIGS. 1, 4, and 5). The rings 13 could be D-shaped as is known in the art within the scope of this invention. Ring mechanisms having ring members formed of a different material or having different cross-sectional shapes, for example, oval shapes, do not depart from the scope of this invention.

As also shown in FIG. 2, the ring mechanism 1 includes two substantially identical hinge plates, designated generally at 27*a*, 27*b*, supporting the ring members 23*a*, 23*b*. respectively. The hinge plates 27*a*, 27*b* are each generally elongate, flat, and rectangular in shape and are each somewhat shorter in length than the housing 11. Four corresponding cutouts 29*a-d* are formed in each of the hinge plates 27*a*, 27*b* along inner longitudinal edges of the plates. Each hinge plate 27*a*, 27*b* has a longitudinal free end defining a longitudinally extending finger 31 (e.g., extending to the right in FIG. 2), and in the illustrated embodiment a bent down finger (e.g., bent an angle relative to the rest of the hinge plate). The fingers 31 are each narrower in width than the respective hinge plates 27*a*, 27*b* and are positioned with their inner longitudinal edges generally aligned with the inner longitudinal edges of the hinge plates. The purpose of the cutouts 29*a-d* and fingers 31 will be described hereinafter.

Figure 3:
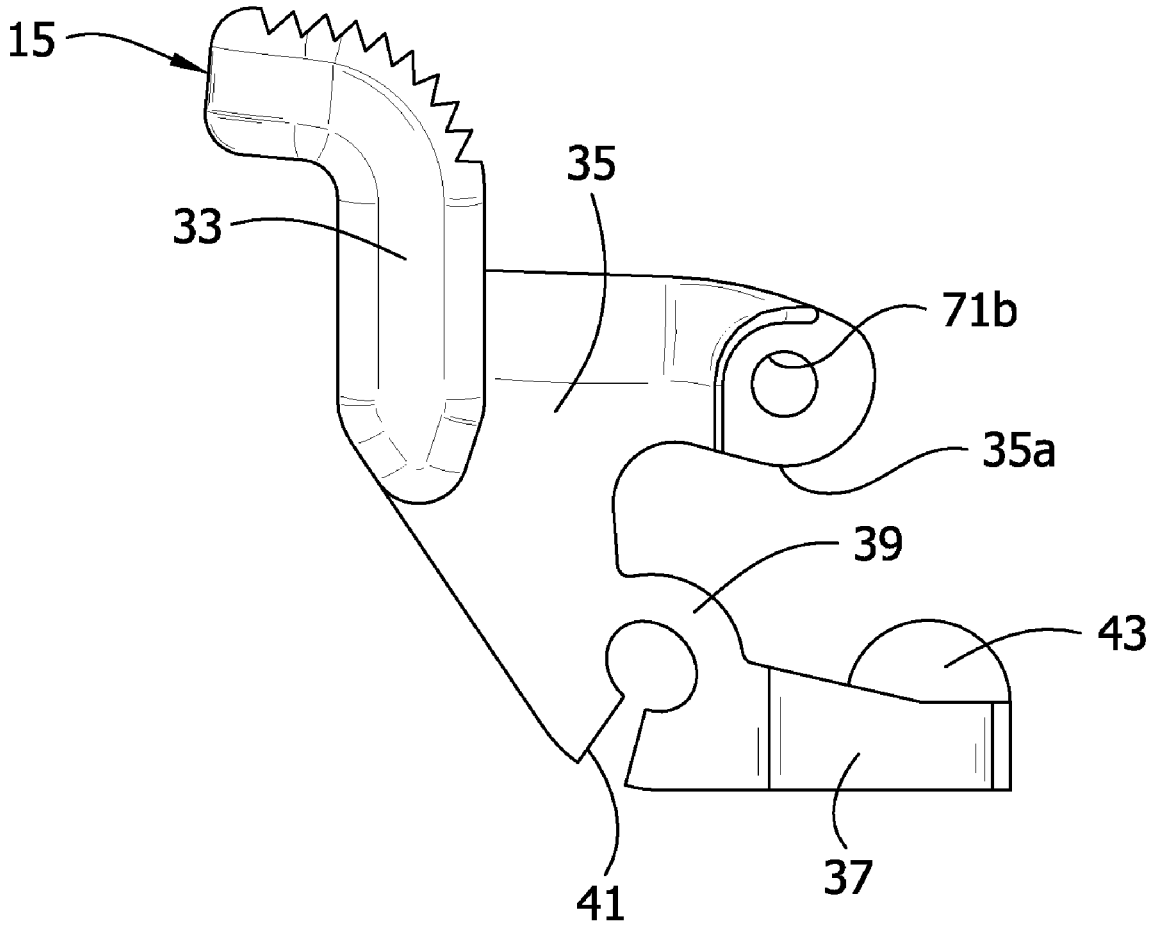
FIG. 3 is an enlarged side view of a lever of the mechanism.

Referring particularly to FIGS. 2 and 3, the lever 15 includes a grip 33 with an inverted "L" shape, a body 35 (a "first portion") attached to the grip, and a tongue 37 (a "second portion") attached to the body. The grip 33 is somewhat broader than both the body 35 and the tongue 37 (FIG. 2) and facilitates grasping the lever 15 and applying force to move the lever. In the illustrated ring mechanism 1, the body 35 is formed as one piece with the grip 33 for substantially conjoint movement with the grip. The body 35 may be formed separate from the grip 33 and attached thereto without departing from the scope of the invention.

As shown in FIG. 3, the tongue 37 of the lever 15 is attached to the body 35 by a flexible bridge 39 (broadly, a "living hinge") formed as one piece with the body and tongue. A ring mechanism having a lever in which a bridge is formed separate from and connecting together a body and/or tongue does not depart from the scope of the invention. The bridge 39 is generally arch-shaped and defines an open channel 41 between the tongue 37 and body 35. The tongue 37 extends away from the body 35 at the bridge 39 and channel 41 in general parallel alignment with an upper lip 35*a* of the body and defines a generally C-shaped space between the body and tongue (e.g., above the bridge). It is envisioned that the lever 15 is formed from a resilient plastic material by, for example, a mold process. But the lever 15 may be formed from other materials or other processes within the scope of this invention. A ring mechanism having a lever shaped differently than illustrated and described herein does not depart from the scope of the invention.

As also shown in FIG. 3, the lever 15 includes a pivot bulb 43 located toward an end of the tongue 37 opposite the bridge 39, the upper bearing surface of which bulb 43 (as shown in FIG. 3) bears against the hinge plates to open the mechanism as shown in more detail below. The bulb 43 may be separate from the tongue 37 and releasably attached thereto by a tab (not shown) inserted through an opening (not shown) in the tongue. As another example, the bulb 43 may be formed as one piece with the tongue 37 within the scope of this invention. Alternatively, in some embodiments, the bulb 43 may be omitted altogether, in which case the bearing surface would be part of the tongue 37 itself.

Referring again to FIG. 2, the ring mechanism 1 further comprises an elongate, generally flat, rectangular travel bar (at least in part broadly defining a "locking system" of the ring mechanism) designated generally at 45. The travel bar 45 has a rectangular mounting groove 47 at a first end (to the right in FIG. 2) and three block-shaped locking elements (each designated generally at 49) along a bottom surface. The locking elements 49 are spaced apart longitudinally along the travel bar 45 with one locking element adjacent each longitudinal end of the travel bar, and one located toward a center of the travel bar. The travel bar 45 may have other shapes or greater or fewer than three locking elements 49 within the scope of this invention. The travel bar 45 could be formed without locking elements and instead carry wedges, for example, that move the hinge plates 27*a*, 27*b*.

The locking elements 49 of the illustrated travel bar 45 are each substantially similar in shape. As best shown in FIGS. 7, 10, 12, and 13, each locking element 49 includes a narrow, flat bottom 53 and generally vertical sides 55*a-d*. The side 55*a* facing away from the lever 15 is angled and the lateral sides 55*b*, 55*d* are converging toward their bottoms to form the narrow, flat bottom 53. In the illustrated embodiment, the locking elements 49 are formed as one piece of material with the travel bar 45 by, for example, a mold process. But the locking elements 49 may be formed separately from the travel bar 45 and attached thereto without departing from the scope of the invention. Additionally, locking elements with different shapes, for example, block shapes (e.g., no angled sides or converging sides), are within the scope of this invention.

Figure 6:
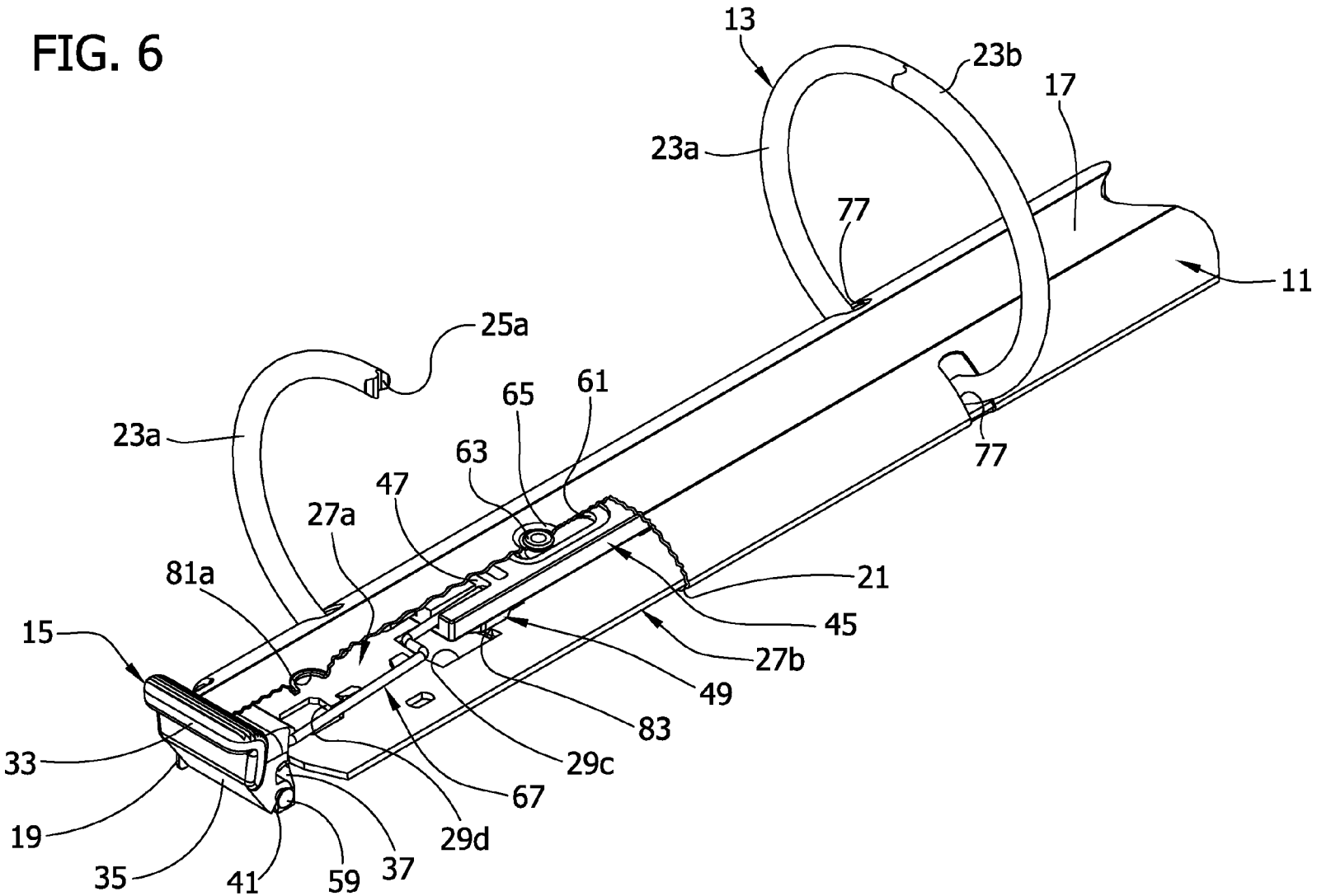
FIG. 6 is an enlarged fragmentary perspective of the ring mechanism with a portion of a housing broken away and with a ring member removed to show internal construction.

The ring mechanism 1 in assembled form will now be described with reference to FIGS. 4-7 in which the ring mechanism is illustrated with the ring members 23*a*, 23*b* in the closed position and the lever 15 in an upright position. The lever 15 pivotally mounts on the first, open end of the housing 11 at the mounting arms 19 of the housing (FIGS. 4-6). A mounting opening 57 (FIG. 2) in each mounting arm 19 aligns with the channel 41 of the lever 15. A hinge pin 59 passes through the aligned openings 57 and channel 41 to pivotally mount the lever on the housing 11. It is envisioned that the mounting arms 19 are one piece with the housing 11, but they may be formed separately from the housing and attached thereto without departing from the scope of the invention.

As shown in FIG. 6, the travel bar 45 is disposed within the housing 11 behind the housing's plateau 17. It extends lengthwise of the housing 11, in generally parallel orientation with a longitudinal axis LA (FIG. 2) of the housing, with the locking elements 49 extending away from the housing. Two elongate openings, each designated 61 (only one is shownin FIG. 6; see also, FIG. 2), through the travel bar 45 align with two rivet openings, each designated 63 (only one is shown in FIG. 6; see also, FIG. 2) of the housing plateau 17. Grooved rivets, each designated 65 (only one is shown in FIG. 6; see also, FIG. 2), secure to the housing 11 at the rivet openings 63 and extend through the respective elongate openings 61 of the travel bar 45 to vertically support the travel bar within the housing. The travel bar 45 fits within the grooves of the rivets 65, allowing it to slide in translation lengthwise of the housing 11 relative to the rivets.

Figure 7:
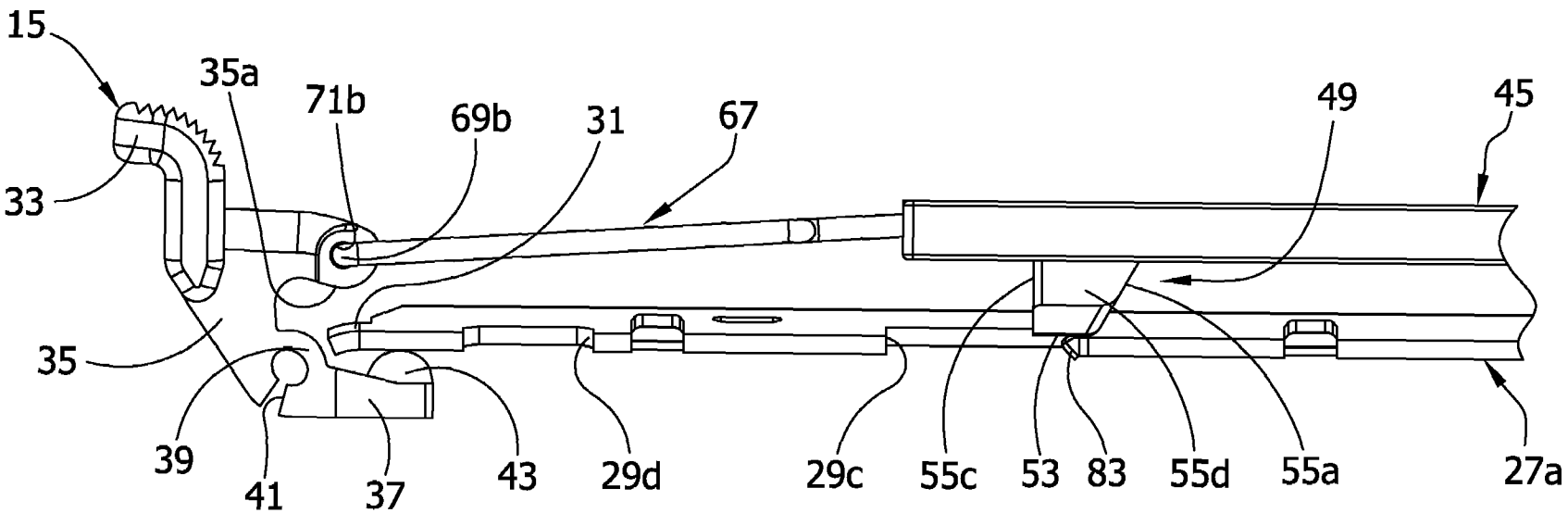
FIG. 7 is a side view thereof with the housing and ring members removed.

Referring to FIGS. 6 and 7, the travel bar 45 is operatively connected to the lever 15 by an intermediate connector (also in part broadly defining the locking system), designated generally at 67. In the illustrated embodiment, the intermediate connector 67 is a wire bent into an elongate, roughly rectangular form (FIG. 2). The intermediate connector 67 may have other shapes or be formed from other material within the scope of this invention. A first end of the intermediate connector 67 is open and includes two free ends 69*a*, 69*b* (FIG. 2) that fit within openings 71*a*, 71*b* (FIG. 3, only opening 71*b* is visible) in the body 35 of the lever 15 to form a pivoting connection. A second, closed end of the intermediate connector 67 is narrowed and includes a bent end 73 (FIG. 2) that fits within the mounting groove 47 of the travel bar 45. The bent end 73 secures the intermediate connector 67 to the travel bar 45 at mounting groove 47 to either push against the travel bar or pull on the travel bar. The bent end 73 allows the intermediate connector 67 to pivot relative to the travel bar 45 to accommodate small vertical movements of the intermediate connector that occur when the lever 15 pivots. A ring binder mechanism lacking an intermediate connector (e.g., in which a travel bar is pivotally connected directly to a lever) does not depart from the scope of this invention.

As shown in FIGS. 5 and 6, the hinge plates 27*a*, 27*b* are interconnected in parallel arrangement along their inner longitudinal edges, forming a central hinge 75 having a pivot axis. This is done in a conventional manner known in the art. As will be described, the hinge plates 27*a*, 27*b* can pivot about the hinge 75 upward and downward. The four cutouts 29*a-d* in each of the two individual hinge plates 27*a*, 27*b* (FIG. 2) align to form four openings also designated 29*a-d* in the interconnected plates (FIG. 5). The housing 11 supports the interconnected hinge plates 27*a*, 27*b* within the housing below the travel bar 45. The outer longitudinal edges of the hinge plates 27*a*, 27*b* loosely seat within the bent under rims 21 of the housing 11 for allowing them to move within the rims when the hinge plates pivot. As shown in FIG. 7, the fingers 31 of the hinge plates 27*a*, 27*b* (only one hinge plate 27*a* is shown) extend into the C-shaped space formed between the tongue 37 and the upper lip 35*a* of the lever body 35 so that lower surfaces of the hinge plates engage the upper, bearing surface of the lever bulb 43. Notably, the various components of the ring mechanism 1 are configured such that the bearing surface of the bulb 43 maintains contact with the lower surfaces of the hinge plates 27*a*, 27*b* (e.g., the lower surfaces of the fingers 31) when the mechanism is in the closed position. Advantageously, this eliminates lever play in the mechanism (and hence possible rattling noise) when the mechanism is in the closed position and imparts a well-engineered "feel" to the mechanism. (If the lever does not include a bulb, the components would be configured such that a bearing surface of the tongue 37, per se, would make continuous contact with the lower surfaces of the hinge plates.)

The ring members 23*a*, 23*b* are each mounted on upper surfaces of respective ones of the hinge plates 27*a*, 27*b* in generally opposed fashion, with the free ends 25*a*, 25*b* facing each other (see also, FIG. 2). The ring members 23*a*, 23*b* extend through respective openings, each designated 77, along sides of the housing 11 so that the free ends 25*a*, 25*b* of the ring members can engage above the housing (e.g., FIG. 4). The ring members 23*a*, 23*b* are rigidly connected to the hinge plates 27*a*, 27*b* as is known in the art and move with the hinge plates when they pivot. Although in the illustrated ring binder mechanism 1 both ring members 23*a*, 23*b* of each ring 13 are each mounted on one of the two hinge plates 27*a*, 27*b* and move with the pivoting movement of the hinge plates, a mechanism in which each ring has one movable ring member and one fixed ring member does not depart from the scope of this invention (e.g., a mechanism in which only one of the ring members of each ring is mounted on a hinge plate with the other ring member mounted, for example, on a housing).

As shown in FIG. 5, two mounting posts 79*a*, 79*b* (see also, FIG. 2) are secured to the illustrated ring mechanism 1 to mount the mechanism on, for example, a notebook 3 (e.g., FIG. 1) in any suitable manner. The posts 79*a*, 79*b* attach to the housing 11 at mounting post openings 81*a*, 81*b* (FIG. 2) of the plateau 17 located toward the longitudinal ends of the housing. A first mounting post 79*a* (toward the left in FIG. 5) extends through the intermediate connector 67 and through mounting post opening 29*d* of the interconnected hinge plates 27*a*, 27*b*.

Figure 9:
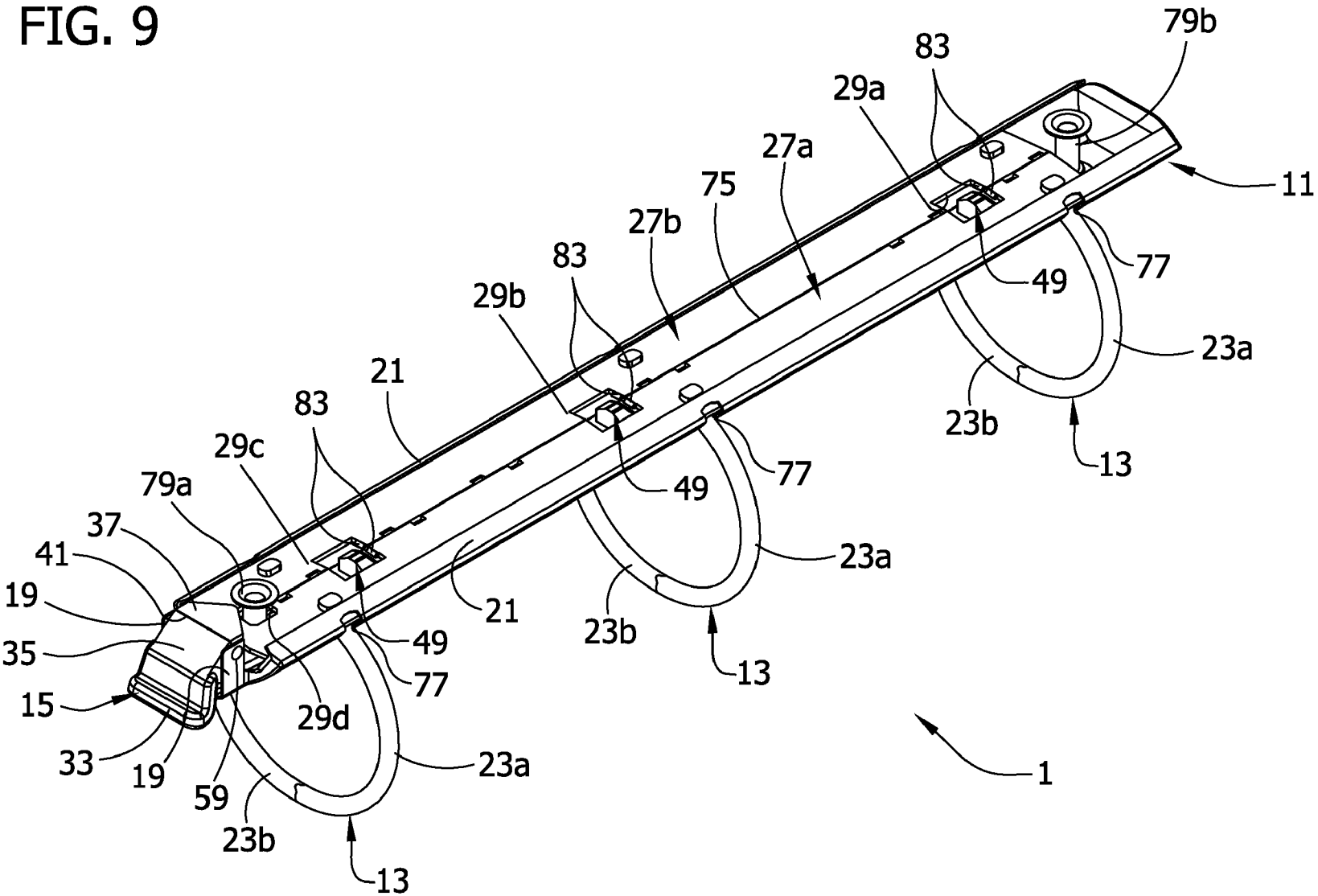
FIG. 9 is a bottom side perspective thereof.
Figure 10:
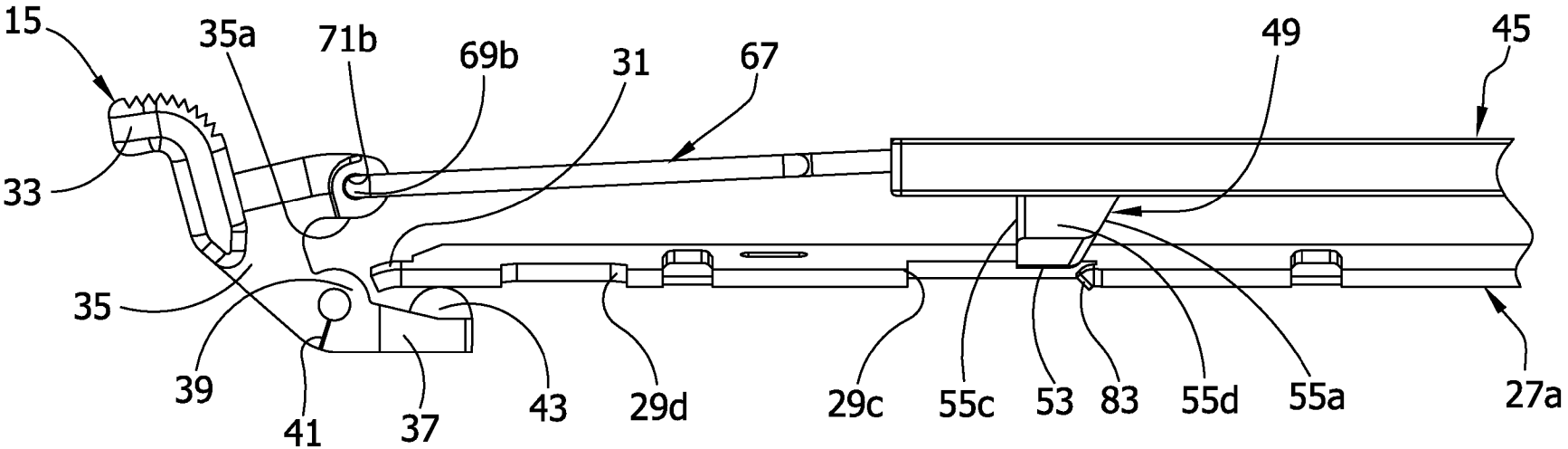
FIG. 10 is an enlarged fragmentary side view thereof with the housing and ring members removed.
Figure 11:
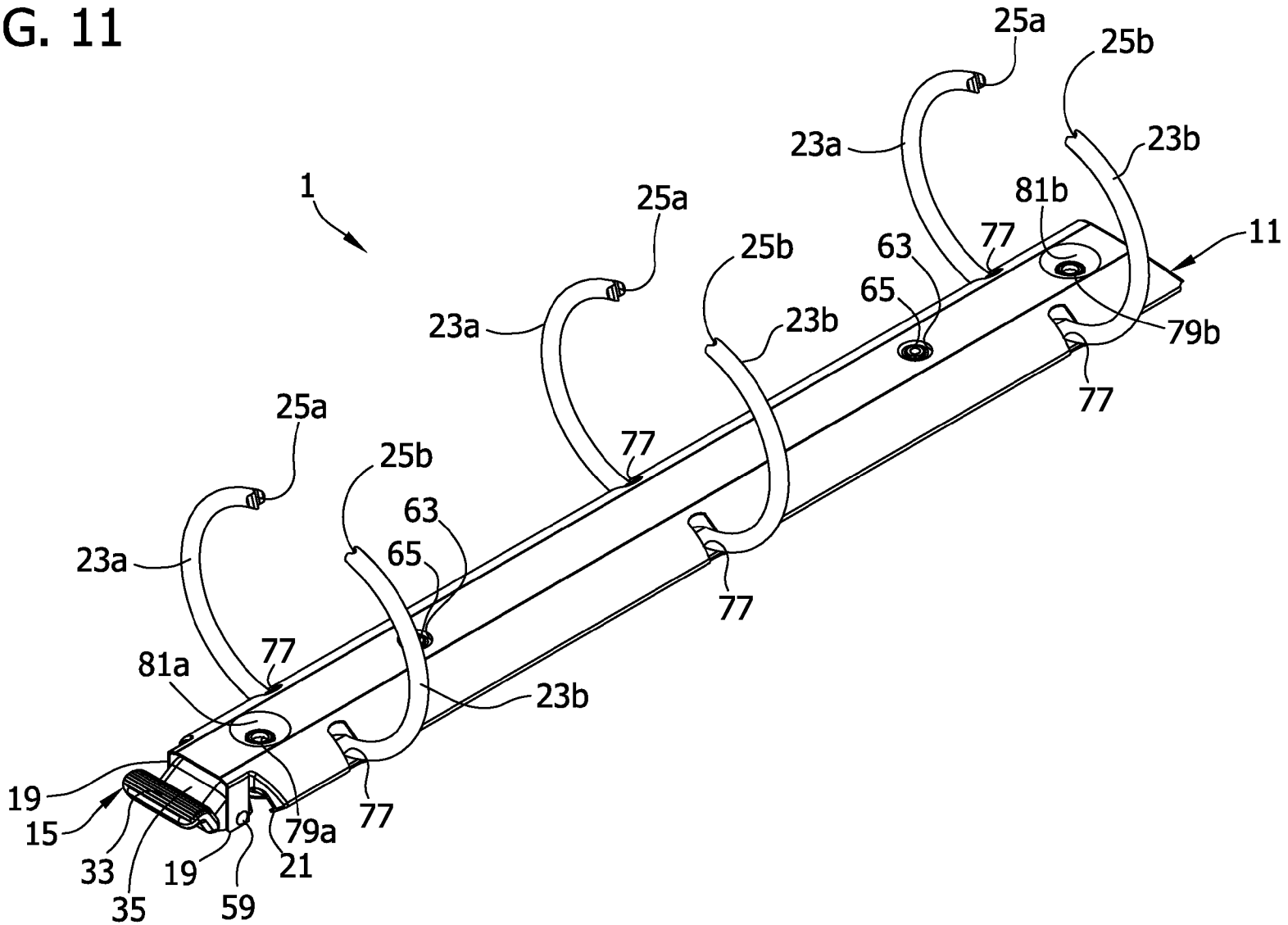
FIG. 11 is a topside perspective of the ring mechanism at an open position with the lever at a second relaxed position.
Figure 12:
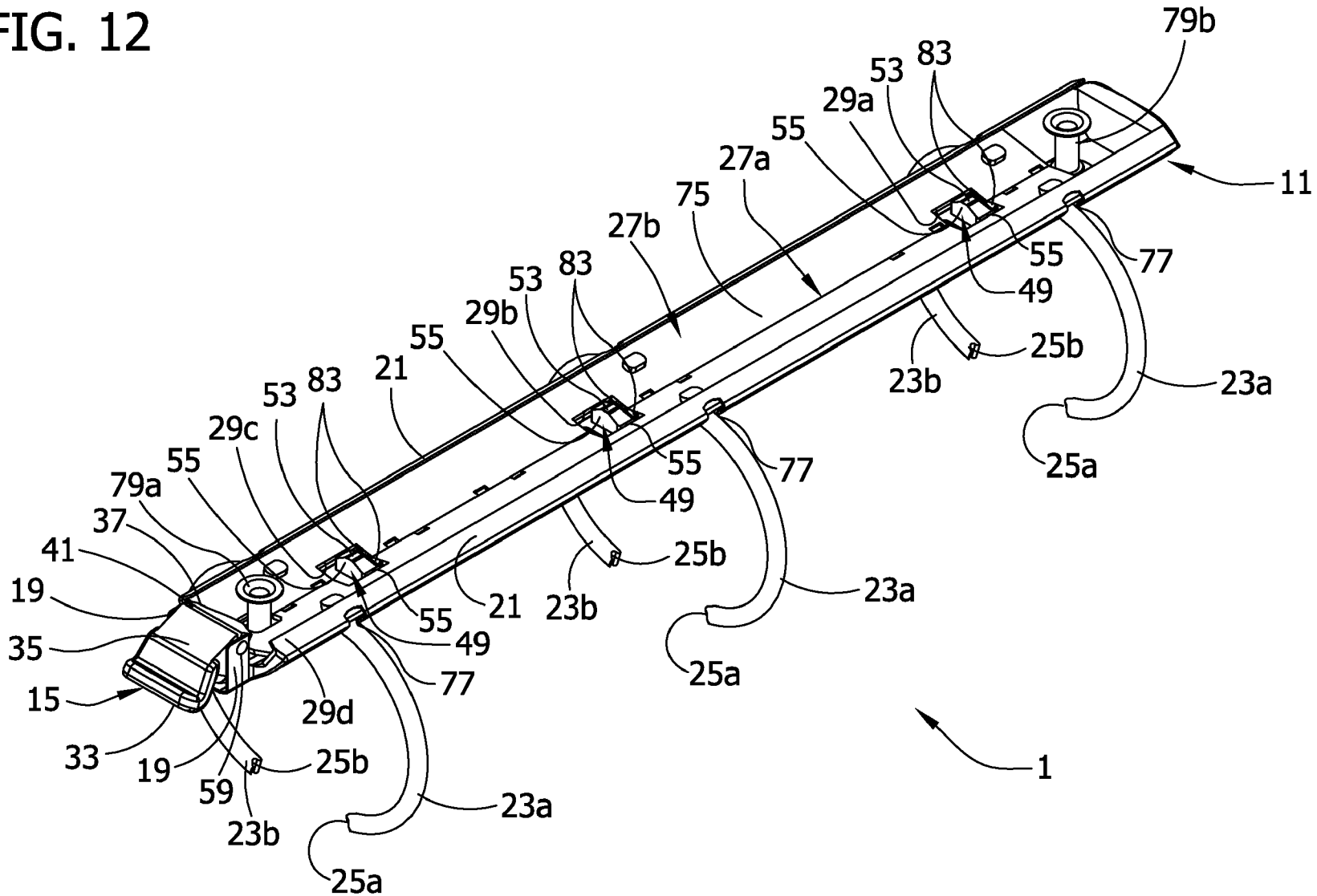
FIG. 12 is a bottom side perspective thereof.
Figure 13:
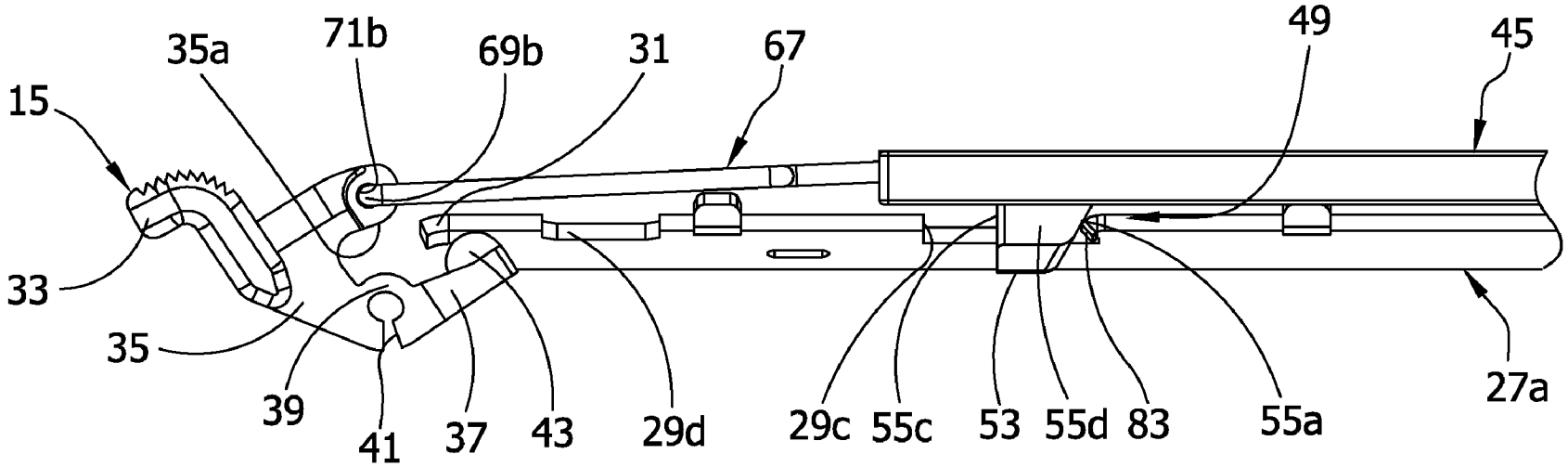
FIG. 13 is an enlarged fragmentary side view thereof with the housing and ring members removed to show internal construction.

Operation of the ring mechanism 1 will be described with reference to FIGS. 4-13. As is known, the hinge plates 27*a*, 27*b* pivot downward and upward relative to the housing 11 and move the ring members 23*a*, 23*b* mounted thereon between a closed position (FIGS. 1, 4-10) and an open position (FIGS. 11-13). The hinge plates 27*a*, 27*b* are wider than the housing 11 when in a co-planar position (180E), so as they pivot through the co-planar position, they deform the housing and create a small spring force in the housing. The housing spring force biases the hinge plates 27*a*, 27*b* to pivot away from the co-planar position, either downward or upward. The ring members 23*a*, 23*b* close when the hinge plates 27*a*, 27*b* pivot downward (i.e., the hinge 75 moves away from the housing 11 (e.g., FIG. 5)). The ring members 23*a*, 23*b* open when the hinge plates 27*a*, 27*b* pivot upward (i.e., the hinge 75 moves toward the housing 11 (e.g., FIG. 12)).

In FIGS. 4-7, the ring mechanism 1 is in a closed and locked position. The hinge plates 27*a*, 27*b* are hinged downward, away from housing 11, so that the ring members 23*a*, 23*b* of each ring 13 are together in a continuous, circular loop, capable of retaining loose-leaf pages. The lever 15 is vertical relative to the housing 11 and in a first relaxed position (the lever is shown in this position in FIG. 3 also) with the lever's contact surface (e.g., the top of the lever bulb 43) continuously engaging the lower surfaces of the hinge plates 27*a*, 27*b*. The locking elements 49 of the travel bar 45 are above the hinge plates 27*a*, 27*b* generally aligned with the hinge 75 with their narrow, flat bottoms 53 contacting the upper surfaces of the hinge plates. As shown in FIG. 5, the locking elements 49 are adjacent respective locking element openings 29*a-c*, but are substantially out of registration with the openings. Together, the travel bar 45 (vertically supported by the grooved rivets 65) and locking elements 49 oppose any force tending to pivot the hinge plates 27*a*, 27*b* upward to open the ring members 23*a*, 23*b* (i.e., they lock the ring members closed).

Figure 8:
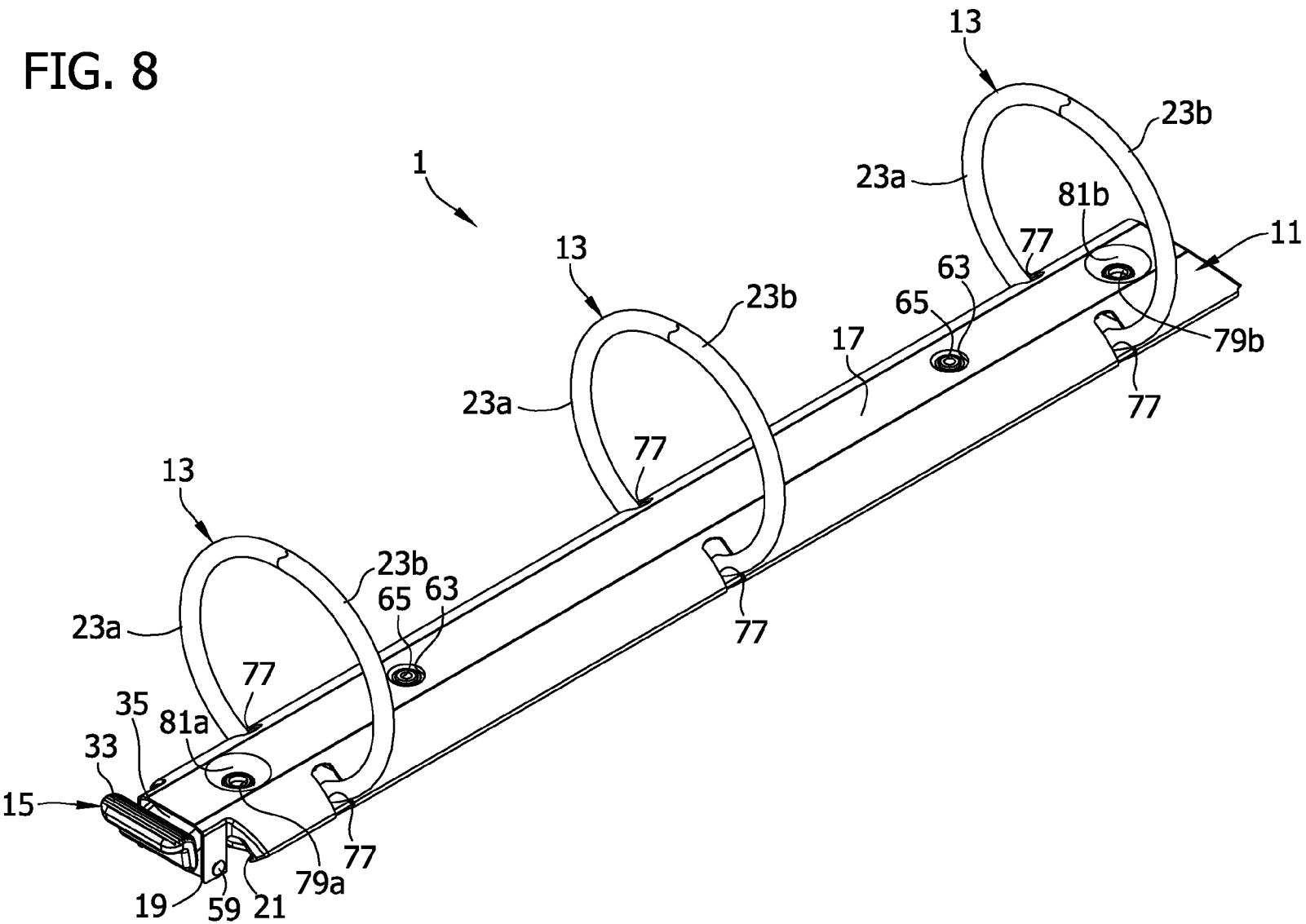
FIG. 8 is a top side perspective of the ring mechanism at a closed and unlocked position with the lever in a deformed position.

To unlock the ring mechanism 1 and open the ring members 23*a*, 23*b*, an operator applies force to the grip 33 of the lever 15 and pivots it counter-clockwise (as viewed in FIGS. 4, 6, and 7). As shown in FIGS. 8-10, the grip 33 and body 35 of the lever 15 move relative to the tongue 37, which is held stationery by the hinge plates 27*a*, 27*b* under the spring force of the housing 11. The intermediate connector 67 simultaneously moves with the body 35 and transfers the pivoting movement of the lever 15 around the mounting post 79*a* to the travel bar 45. The travel bar slides toward the lever 15 and moves the locking elements 49 into registration with the respective locking element openings 29*a-c* of the hinge plates 27*a*, 27*b*. The bridge 39 between the lever body 35 and lever tongue 37 flexes and tensions as the open channel 41 closes and the body moves into engagement with the tongue (FIG. 10). If the lever 15 is released before the hinge plates 27*a*, 27*b* pivot upward through their co-planar position (i.e., before the ring members 23*a*, 23*b* open), the tension in the bridge 39 will automatically recoil (and push) the grip 33 and body 35 back to the vertical position, moving the travel bar 45 and locking elements 49 to the locked position.

The lever channel 41, now closed, no longer separates the tongue 37 from the pivoting movement of the grip 33 and body 35. Continued opening movement of the lever 15 (e.g., in the counter-clockwise direction) causes the body 35 to conjointly pivot the tongue 37. The lever bulb 43 urges the interconnected hinge plates 27*a*, 27*b* to pivot upward over the locking elements 49 at the locking element openings 29*a-c* and relative to the mounting post 79*a* at the mounting post opening 29*d*. Once the hinge plates 27*a*, 27*b* pass just through the co-planar position, the housing spring force pushes them upward, opening the ring members 23*a*, 23*b* (FIGS. 11-13) and moving the mechanism to its open configuration. The lever 15 can be released. The tension in the bridge 39 recoils (and urges) the grip 33 and body 35 away from the tongue 37, which is held stationary against the hinge plates 27*a*, 27*b* via the lever bulb 43 engaging the lower surfaces of the hinge plates. The channel 41 opens and the travel bar 45 moves slightly away from the lever 15. The lever is again relaxed, in a second relaxed position substantially identical to the first relaxed position (e.g., FIG. 3), and the locking elements 49 are at rest within the respective hinge plate openings 29*a-c* free of any forces tending to move them relative to the housing 11. Notably, the components of the mechanism are configured such that the sides 55*a* of the locking elements 49 facing away from the lever 15 bear against facing edges of the hinge plate's locking element openings 29*a-c*, e.g., against tangs 83 at the edges of the locking element openings. Advantageously, that prevents the lever from pivoting back toward its locked position; in other words, it eliminates play in the mechanism when the mechanism is in its open, unlocked position.

To close the ring members 23*a*, 23*b* and return the mechanism 1 to the locked position, an operator manually pushes the free ends 25*a*, 25*b* of the ring members together. The hinge plates 27*a*, 27*b* pivot downward, and rotate the lever tongue 37 clockwise (as viewed in FIGS. 11 and 13). The tongue 37 moves relative to the grip 33 and body 35, which are held stationary by the locking elements 49 against tangs 83 (FIG. 13). The lever channel 41 closes (and the lever bridge 39 flexes) allowing the hinge plates 27*a*, 27*b* to pivot to and through the co-planar position and past the narrow bottoms 53 of the locking elements 49. The angled sides 55*a* of the locking elements 49 allow the locking elements to move incrementally away from the lever 15 and out of the respective opening 29*a-c* as the hinge plates 27*a*, 27*b* move down. This allows the lever 15 to pivot slightly with the tongue 37 as the tongue channel 41 closes. The angled sides of the locking elements are not necessary for operation though.

Once the hinge plates 27*a*, 27*b* clear the bottoms 53 of the locking elements 49, the tongue 37 pushes the body 35 and grip 33 to the vertical position and the travel bar 45 and locking elements move to the locked position. The ring members 23*a*, 23*b* of the ring mechanism 1 could be closed by a modified lever capable of engaging the hinge plates 27*a*, 27*b* and pivoting them downward within the scope of the invention.

It should now be apparent that the flexibility of the lever bridge 39 allows the grip 33 and body 35 of the lever 15 to move relative to the tongue 37. This moves the lever 15 between the relaxed position (FIGS. 3-7 and 11-13) and a deformed (broadly, "reconfigured") position (FIGS. 8-10). The deformed position of the lever 15 is an unstable, intermediate position in which the bridge 39 is tensioned to always move the grip 33, body 35, and tongue 37 to the relaxed position (i.e., reconfigure the lever).

When the lever 15 pivots to open the ring members 23*a*, 23*b*, the travel bar 45 and locking elements 49 move immediately and prior to the tongue 37 and bulb 43 being able to pivot the hinge plates 27*a*, 27*b* upward (notwithstanding the continuous contact by the bulb 43 with the bottom surfaces of the hinge plates). This "lost motion" caused by the open channel 41 allows the locking elements 49 to move into registration with the locking element openings 29*a-c* of the hinge plates 27*a*, 27*b* before the hinge plates pivot such that they (the locking elements 49) do not interfere with the desirable pivoting movement of the hinge plates 27*a*, 27*b*. After the locking elements 49 move into registration with the respective openings 29*a-c*, the channel 41 closes and the grip 33, body 35, and tongue 37 conjointly pivot to move the hinge plates 27*a*, 27*b* upward.

In addition, when the ring members 23*a*, 23*b* are open and the lever 15 is relaxed, the locking elements 49 and travel bar 45 are free of forces tending to move them to the locked position. Thus, there is no tendency for the open ring members 23*a*, 23*b* to inadvertently close under the influence of the lever 15, locking elements 49, or travel bar 45 as an operator loads or removes pages from the ring members 23*a*, 23*b*.

Similarly when the ring members 23*a*, 23*b* are moved to the closed position, the lever channel 41 allows the hinge plates 27*a*, 27*b* to pivot downward over the locking elements 49 before the grip 33 and body 35 of the lever 15 push the travel bar 45 and locking elements 49 to the locked position. Here, the lost motion caused by the open channel 41 maintains a continuous engagement between the lever tongue 37 and the hinge plates 27*a*, 27*b* (via the lever bulb 43) without risk of the mechanism jamming in the open position (e.g., as may occur if the lever tongue is unable to move downward with the hinge plates because the locking elements 49 wedge against edges of the locking element openings 29*a-c* of the hinge plates, holding the hinge plates from further pivoting downward). The continuous engagement between the lever tongue 37 and the lower surfaces of the hinge plates 27*a*, 27*b* (via lever bulb 43) ensures that the body 35 and grip 33 of the lever 15 move fully to their vertical position when the hinge plates 27*a*, 27*b* are pivoted downward (and the ring members 23*a*, 23*b* are closed), moving the travel bar 45 and locking elements 49 fully to the locked position.

Thus, the ring binder mechanism 1 effectively retains loose-leaf pages when ring members 23*a*, 23*b* are closed, and readily prevents the closed ring members 23*a*, 23*b* from unintentionally opening. The lever 15 positions the travel bar 45 and its locking elements 49 in the locked position when the ring members 23*a*, 23*b* close, eliminating the need to manually move the lever 15 to positively lock the mechanism 1. The ring mechanism 1 incorporating the locking lever 15 requires no additional biasing components (e.g., springs) to perform the locking operation, and requires no specially formed parts to accommodate such biasing components.

Figure 14:
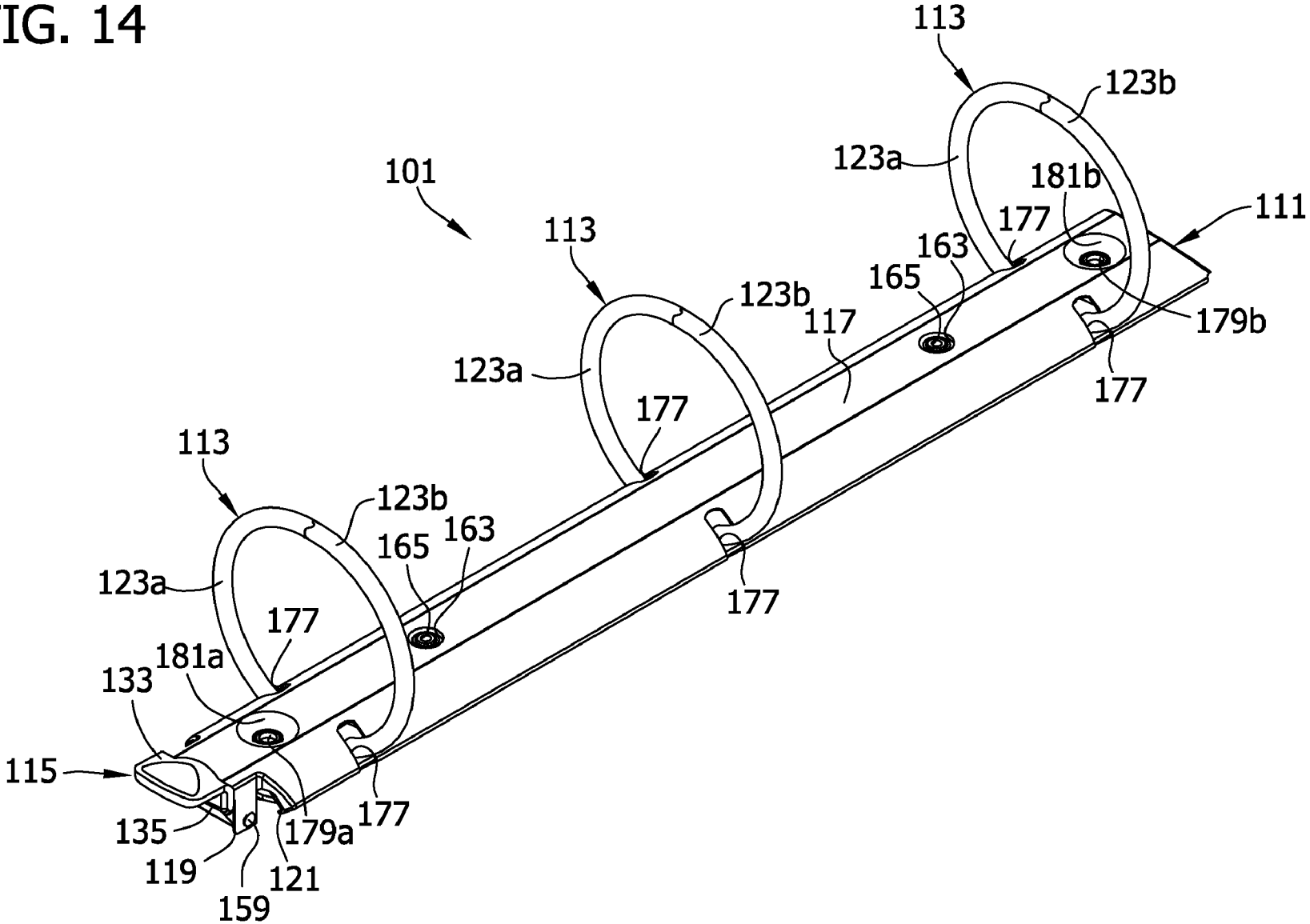
FIG. 14 is a top side perspective of a ring mechanism according to a second embodiment at the closed and locked position.
Figure 15:
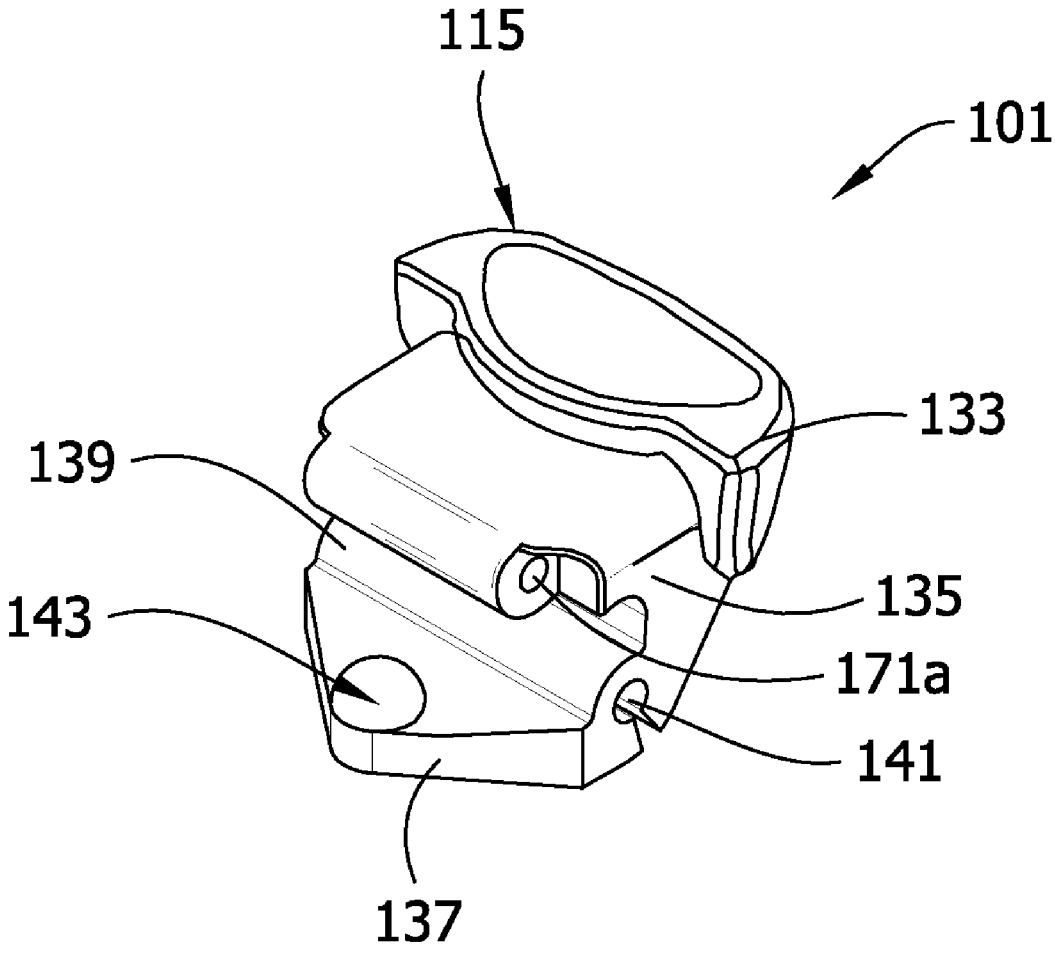
FIG. 15 is an enlarged top side perspective of a lever thereof.
Figure 16:
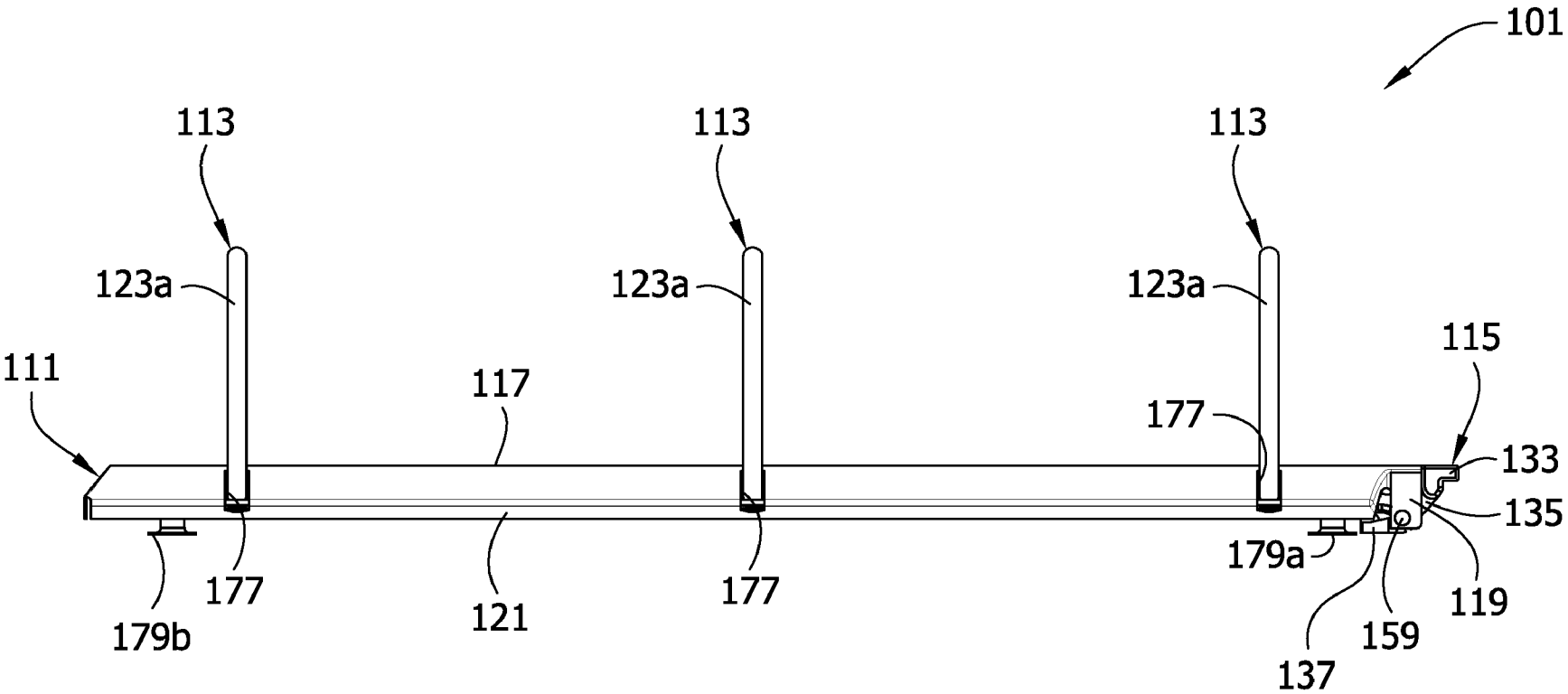
FIG. 16 is a side view of the ring mechanism.

FIGS. 14-16 show a second embodiment of the ring binder mechanism generally at 101. The ring mechanism 101 is substantially the same as the ring mechanism 1 of the first embodiment previously described and illustrated in FIGS. 1-13, and parts of this ring mechanism 101 corresponding to parts of the prior ring mechanism 1 are designated by the same reference numerals, plus "100". The lever 115 of this second embodiment has a low profile in that it includes a substantially flat grip 133. The lever 115 mounts on the housing 111 (FIGS. 14 and 16) as previously described for the ring mechanism 1 of FIGS. 1-13, and the flat grip 133 is positioned in general alignment (i.e., is generally co-planar) with the plateau 117 of the housing. In all other aspects, including operation, the ring mechanism 101 is the same as the ring mechanism 1 of FIGS. 1-13.

FIGS. 17-21 show a third embodiment of the ring binder mechanism generally at 201. Parts of this ring mechanism corresponding to parts of the ring mechanism 1 of the first embodiment of FIGS. 1-13 are designated by the same reference numerals, plus "200". This mechanism 201 is substantially the same as the ring mechanism 1 of FIGS. 1-13, with the exception that the desired lost motion is provided by bending of the hinge plates 227*a*, 227*b* instead of by the particular configuration and operation of the actuator (e.g., the lever 215). In particular, the lever 215 of this third embodiment is formed without a bridge and without a channel between the body 235 and the tongue 237. Other components of the ring mechanism 201, as well as assembly of the components, are substantially the same as those of the mechanism 1 of FIGS. 1-13.

Figure 19:
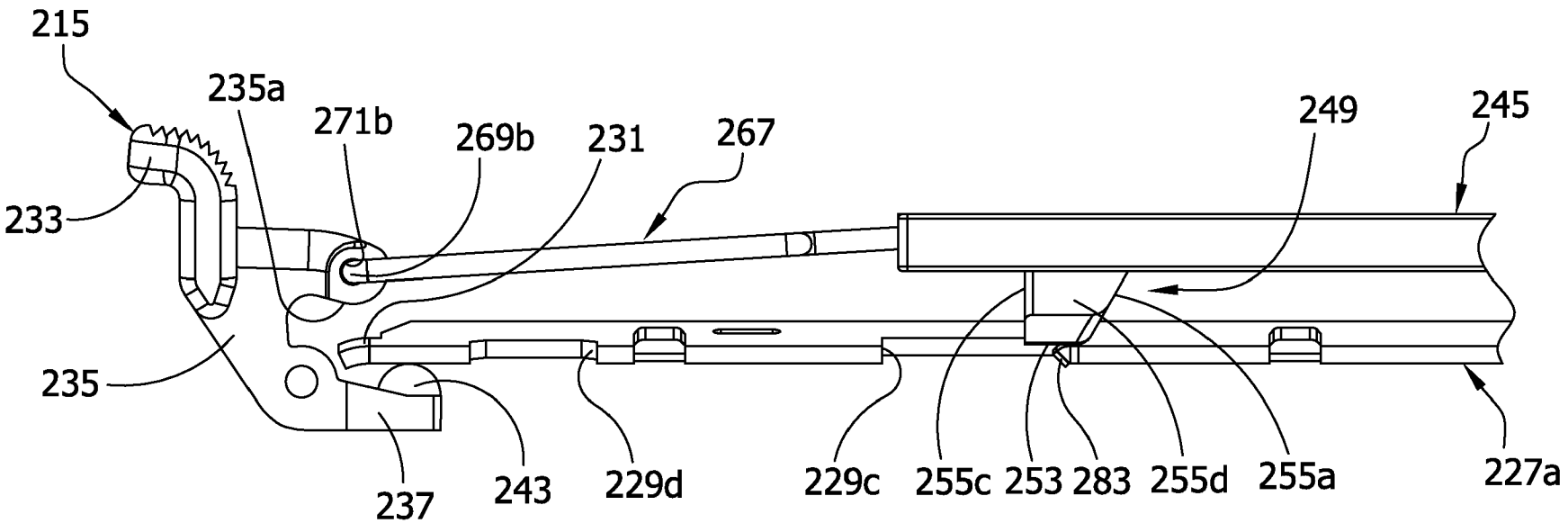
FIG. 19 is an enlarged fragmentary side view of the ring mechanism with a housing and ring members removed.
Figure 20:
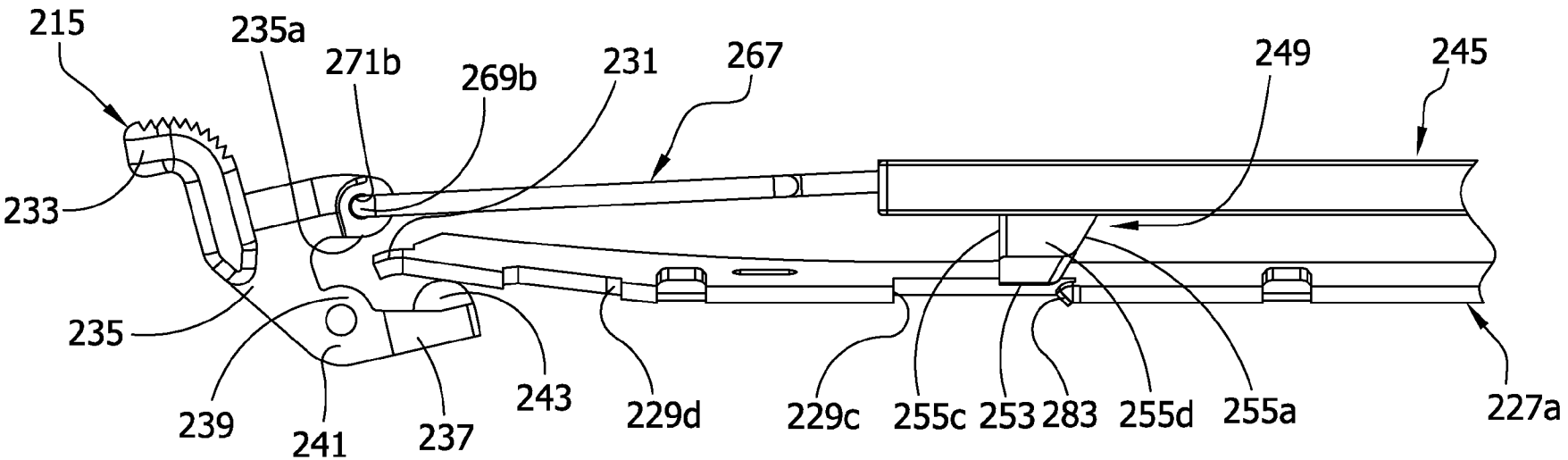
FIG. 20 is an enlarged fragmentary side view similar to FIG. 19 with the mechanism at the closed and unlocked position.

Operation of the ring mechanism 201 will be described with reference to the enlarged fragmentary views of FIGS. 19-21. In FIG. 19, the ring mechanism 201 is in the closed and locked position (similar to the closed position of the ring mechanism 1 of FIGS. 1-13). To unlock the ring mechanism 201 and open the ring members 223*a*, 223*b*, an operator pivots the lever 215 outward and downward (counter-clockwise as viewed in FIG. 19). The lever body 235 pulls the travel bar 245 and locking elements 249 toward the lever 215, while the lever bulb 243 simultaneously pushes upward on the hinge plates 227*a*, 227*b* (only one hinge plate 227*a* is shown). But the locking elements 249, still behind the hinge plates 227*a*, 227*b*, block their upward movement. So as the lever 215 continues to pivot, the lever bulb 243 flexes or bends (and thereby tensions) the hinge plates 227*a*, 227*b* adjacent the free ends of the hinge plates, such as at the fingers 231 (FIG. 20).

Figure 17:
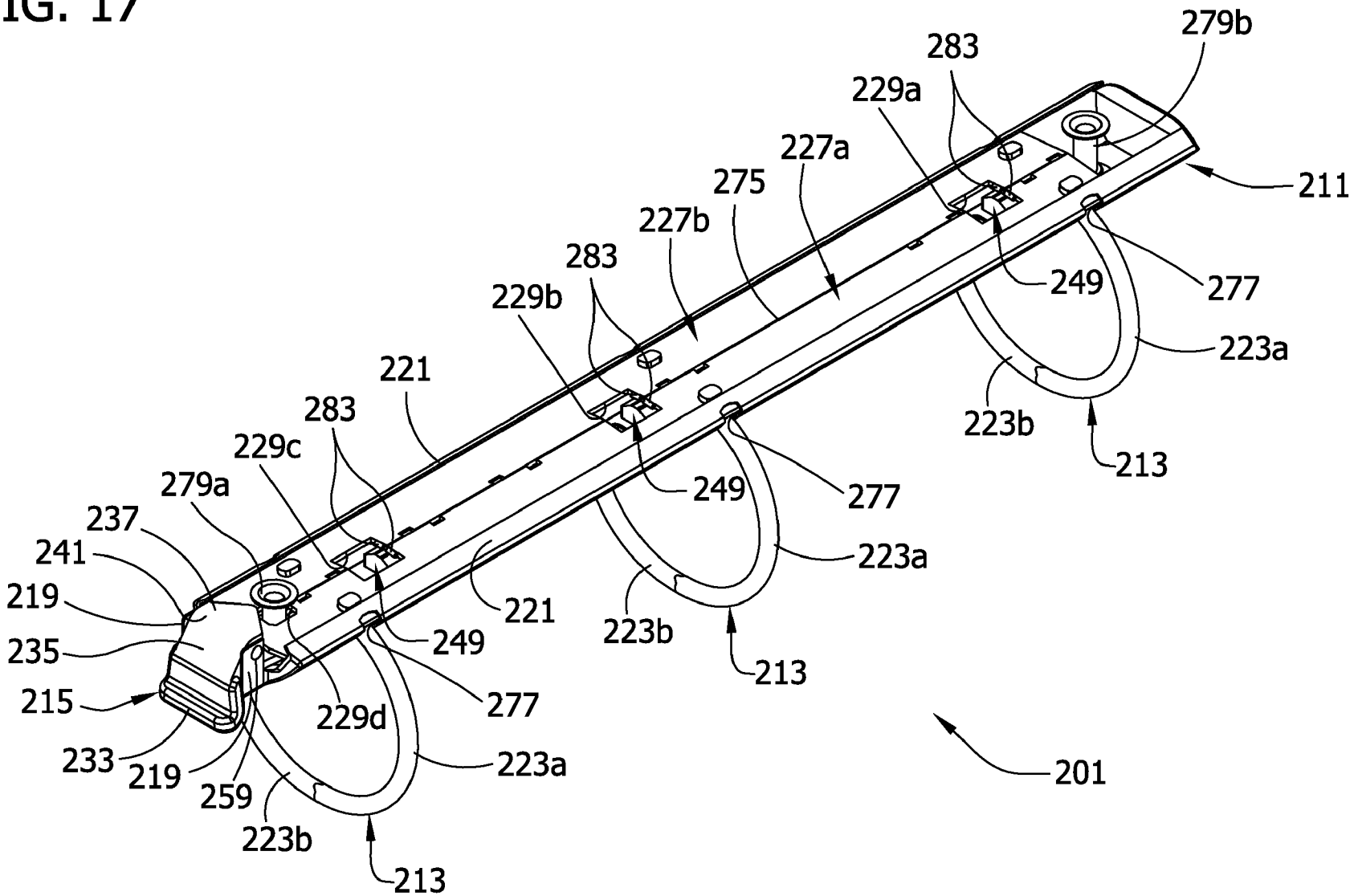
FIG. 17 is a bottom side perspective of a ring mechanism according to a third embodiment at the closed and locked position.
Figure 18:
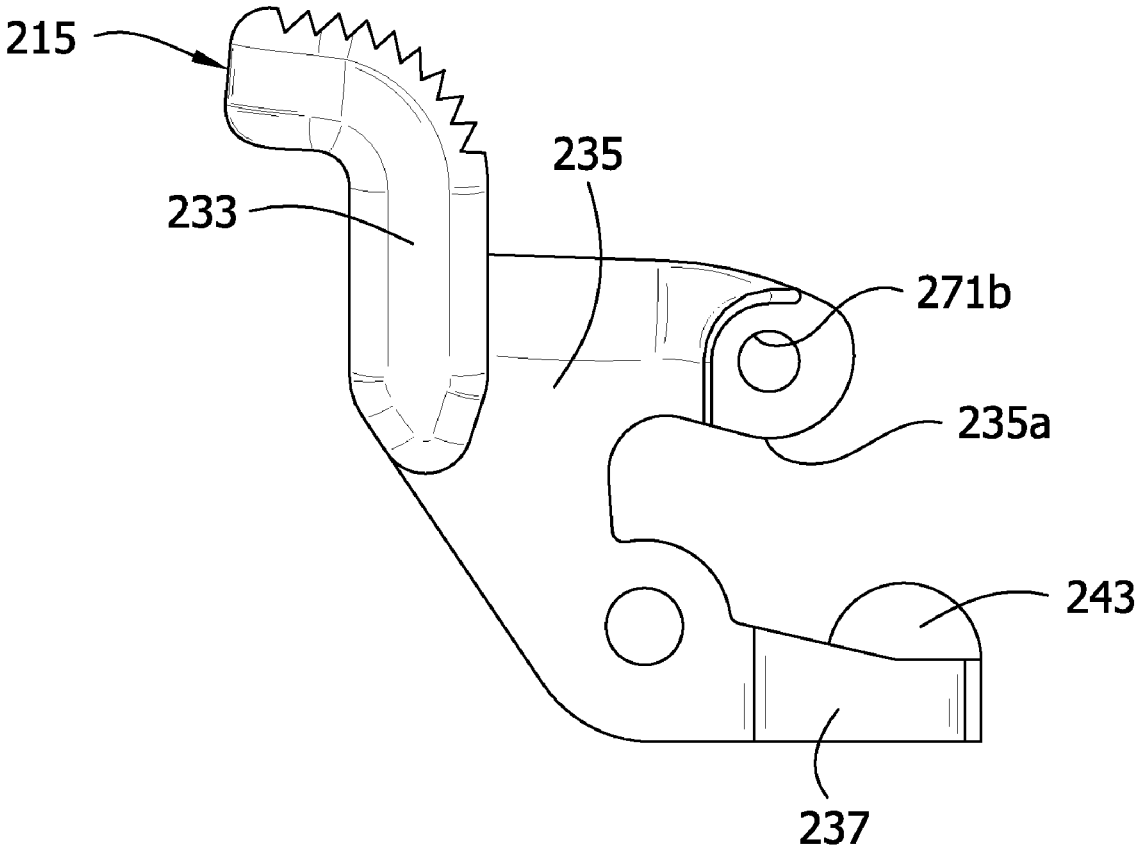
FIG. 18 is an enlarged side view of a lever thereof.
Figure 21:
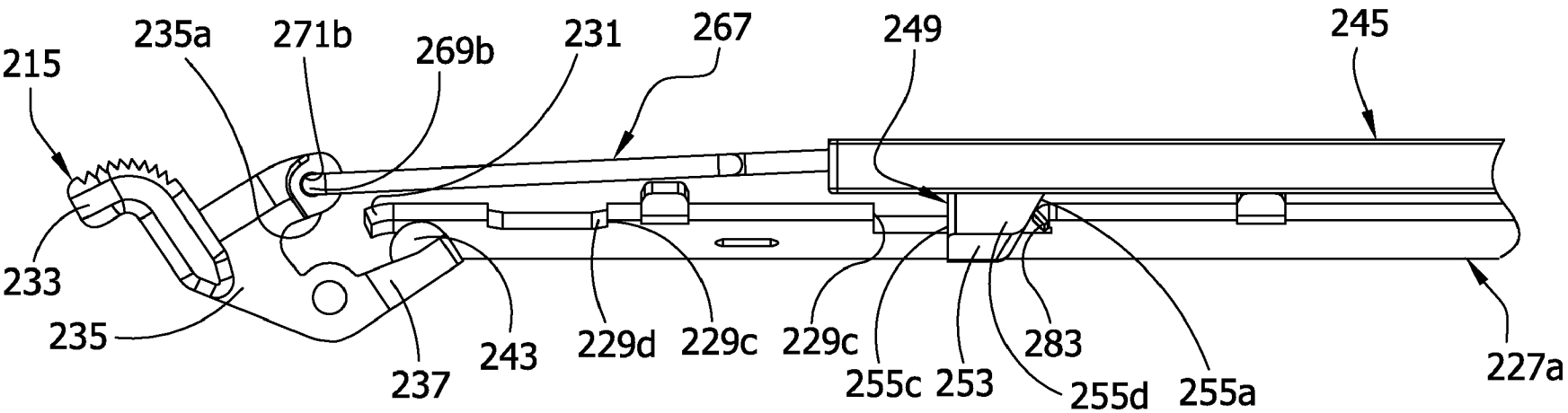
FIG. 21 is an enlarged fragmentary side view similar to FIG. 19 with the mechanism at the open position.
Figure 22:
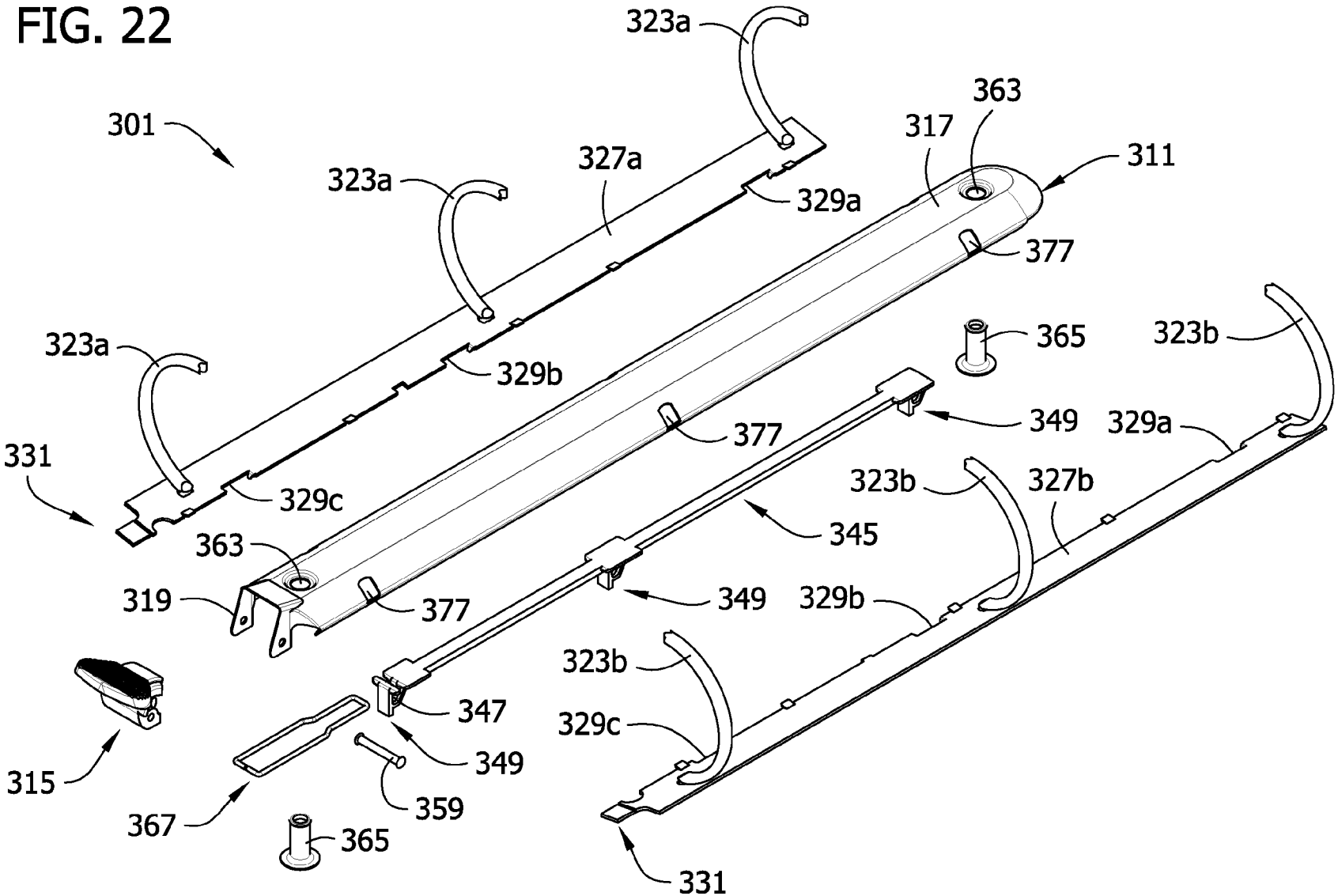
FIG. 22 is an exploded perspective of a ring mechanism according to a fourth embodiment.

Once the locking elements 249 (only one is shown) move into registration with the locking element openings 229*a-c* (only opening 229*c* is shown) of the hinge plates 227*a*, 227*b*, the tensioned hinge plates immediately pivot upward, through the co-planar position (FIG. 21) to open the ring members 223*a*, 223*b* (which are not shown in FIG. 21, see FIG. 17). The tension in the hinge plates 227*a*, 227*b* dissipates and the lever 215 can be released. The bulb 243 of the tongue 237 remains in engagement with the lower surfaces of the hinge plates 227*a*, 227*b*, and the spring force of the housing 211 holds the hinge plates hinged upward. The locking elements 249 are at rest within the respective hinge plate cutout openings 229*a-c* free of any forces tending to move them to the locked position.

As in the ring mechanism 1 of FIGS. 1-13, to close the ring members 223*a*, 223*b* of this mechanism 201 and return the mechanism to the locked position (FIG. 19), an operator manually pushes the free ends 225*a*, 225*b* of the ring members together. In this ring mechanism 201, the hinge plates 227*a*, 227*b* pivot downward and cause the lever bulb 243 and tongue 237 to rotate clockwise (as viewed in FIG. 21). The locking elements 249 instantaneously resist movement of the lever 215, and thus downward movement of the hinge plates 227*a*, 227*b*, causing the hinge plates 227*a*, 227*b* to slightly flex adjacent their fingers 231. The hinge plates 227*a*, 227*b* bend down while the lever 215 and finger 231 remain relatively stationary. The angled sides 255*a* of the locking elements 249 allow the locking elements to move small amounts away from the lever 215 as the hinge plates 227*a*, 227*b* bend, allowing the lever to pivot slightly. Once the hinge plates 227*a*, 227*b* clear the narrow bottoms 253 of the locking elements 249, the tension in the flexed hinge plates immediately pivots the lever 215 to its vertical position, pushing the travel bar 245 and locking elements 249 to the locked position.

In this ring mechanism 201, the unique cooperation between the lever 215, the hinge plates 227*a*, 227*b*, and the locking elements 249 allows the mechanism to operate between the closed and locked position and the open position. When opening the ring members 223*a*, 223*b*, the hinge plates 227*a*, 227*b* briefly flex upward to allow the lever 215 to pivot to move the locking elements 249 into registration with the locking element openings 229*a-c* of the hinge plates. The lever 215, together with the tension from the flexed hinge plates 227*a*, 227*b* and the spring force of the housing 211, then pivot the hinge plates over the locking elements 249 to open the ring members 223*a*, 223*b*. When closing the ring members 223*a*, 223*b*, the hinge plates 227*a*, 227*b* again flex to allow the plates to pivot downward over the locking elements 249 (the angled sides 255*a* of the locking elements 249 also aid in this operation, but are not necessary for this operation).

FIGS. 22-31 illustrate a fourth embodiment of a ring mechanism, indicated generally at 301. Generally speaking, like the previous embodiment of FIGS. 17-21, in this embodiment the ring mechanism 301 is configured to provide the desired lost motion via flexing or bending of the hinge plates 327*a*, 327*b*. This ring mechanism 301 is substantially the same as the ring mechanism 201 of FIGS. 17-21, with the lever 315 formed without a bridge and without a channel between the body of the lever and the tongue 337. The hinge plates 327*a* and 327*b* are particularly constructed to facilitate flexing (e.g., bending) of the hinge plates proximate the free ends thereof, and more particularly to facilitate bending of the fingers 331 at the free ends of the hinge plates (e.g., relative to the remaining portion, or main portion, of each hinge plate), to ensure registration of the locking elements 349 with the cutouts 329*a*-329*c* when the hinge plates pivot into the open position.

Figure 23:
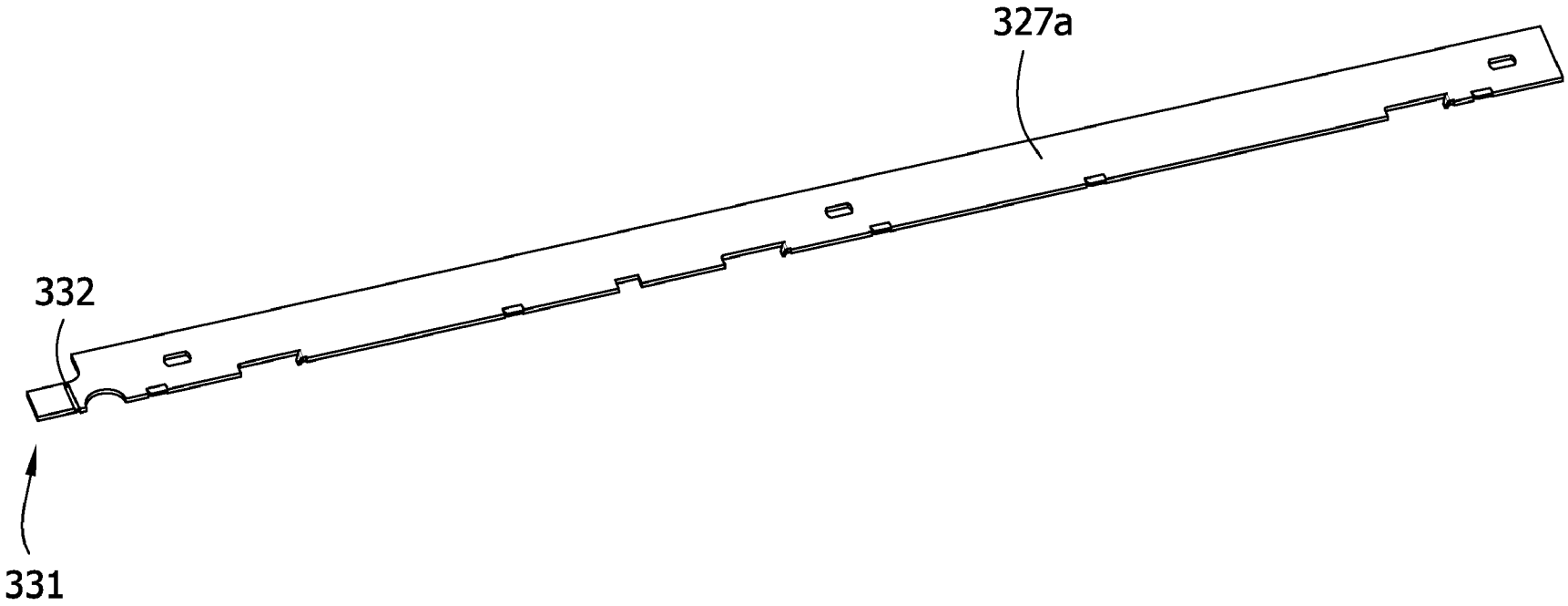
FIG. 23 is a side perspective of a hinge plate used therein.
Figure 24:
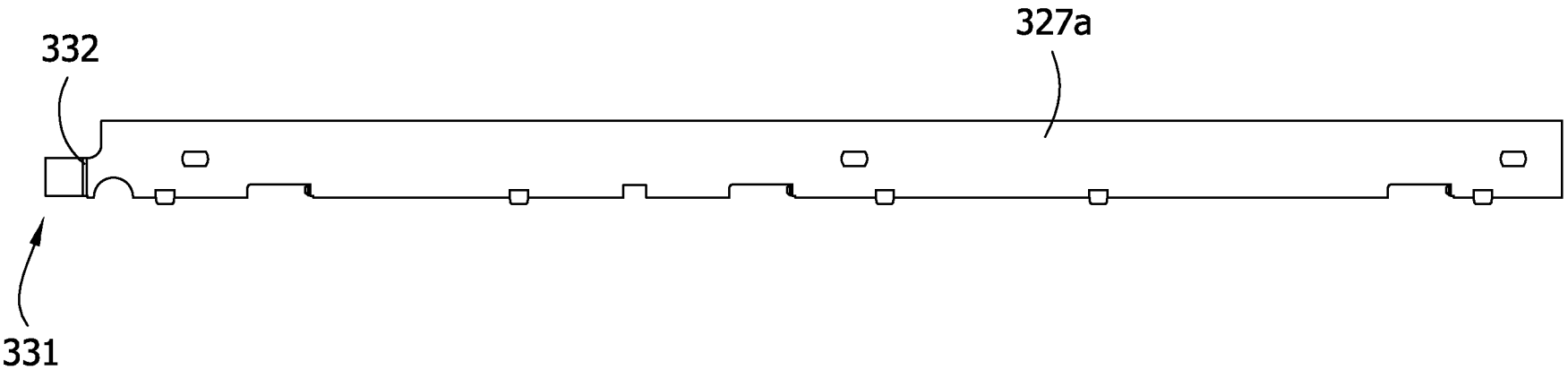
FIG. 24 is a plan view of the hinge plate shown in FIG. 23.

In particular, as seen best in FIGS. 23 and 24, a line of weakness in the form of a transversely extending channel (e.g., a score line) 332 is formed in each hinge plate 327*a*, 327*b* proximate the free ends of the hinge plates, and more particularly transversely across the fingers 331 such as at a base of the fingers where the fingers 331 extend respectively from the main longitudinal extents, or main portions of the hinge plates). These channels 332 reduce the bending stiffness (i.e., the resistance to bending) of the hinge plates 327*a*, 327*b*, and in particular of the fingers 331 relative to the rest or main portions of the hinge plates. Other components of the ring mechanism 301, as well as assembly of the components, are substantially the same as those of the mechanism 201 of FIGS. 17-21.

Figure 25:
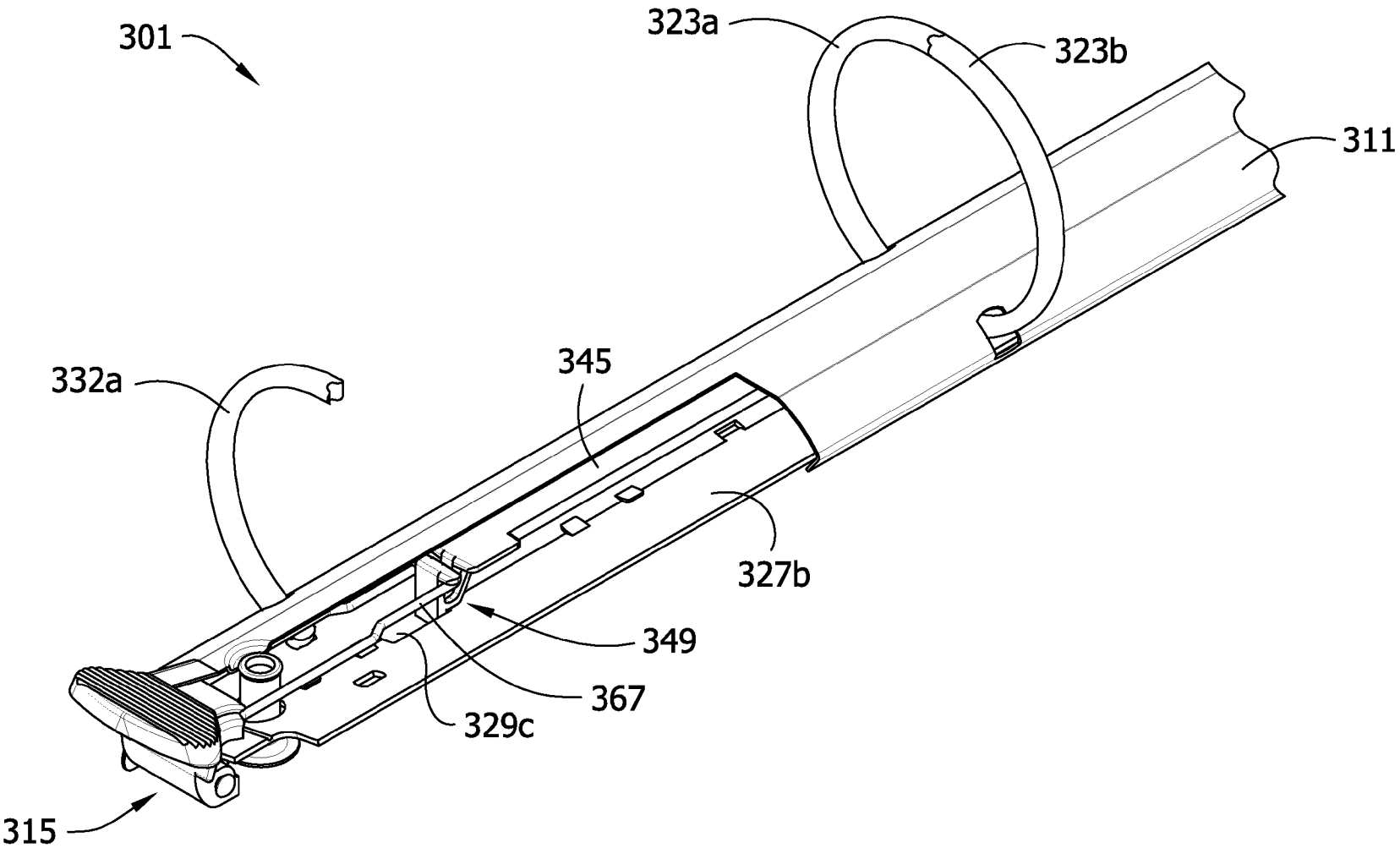
FIG. 25 is an enlarged fragmentary perspective of the ring mechanism with a portion of a housing broken away and with a ring member removed to show internal construction.
Figure 26:
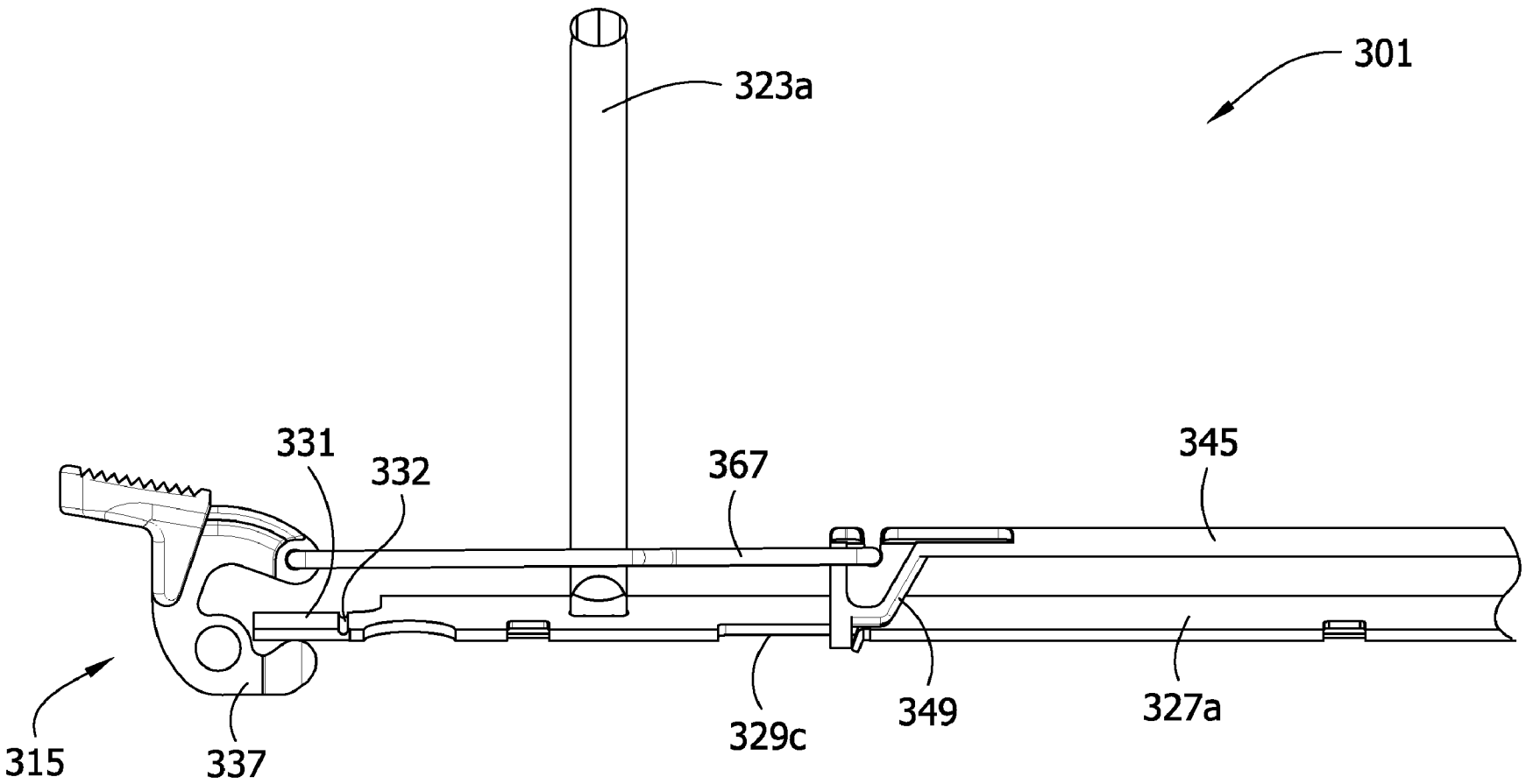
FIG. 26 is a side view thereof with the housing removed showing the mechanism in a closed and locked position.
Figure 27:
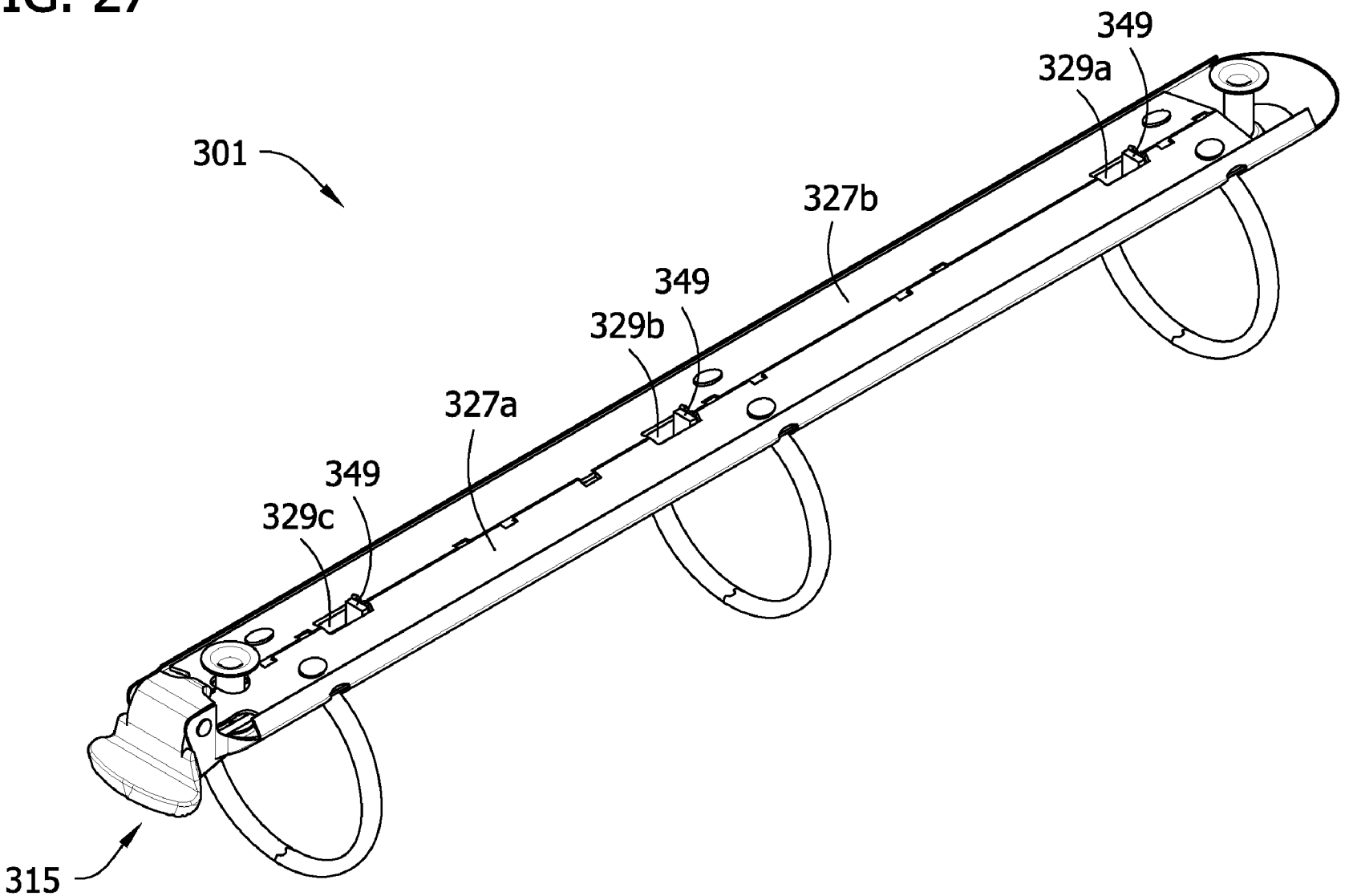
FIG. 27 is a bottom perspective view of the ring mechanism at the closed and locked position.
Figure 28:
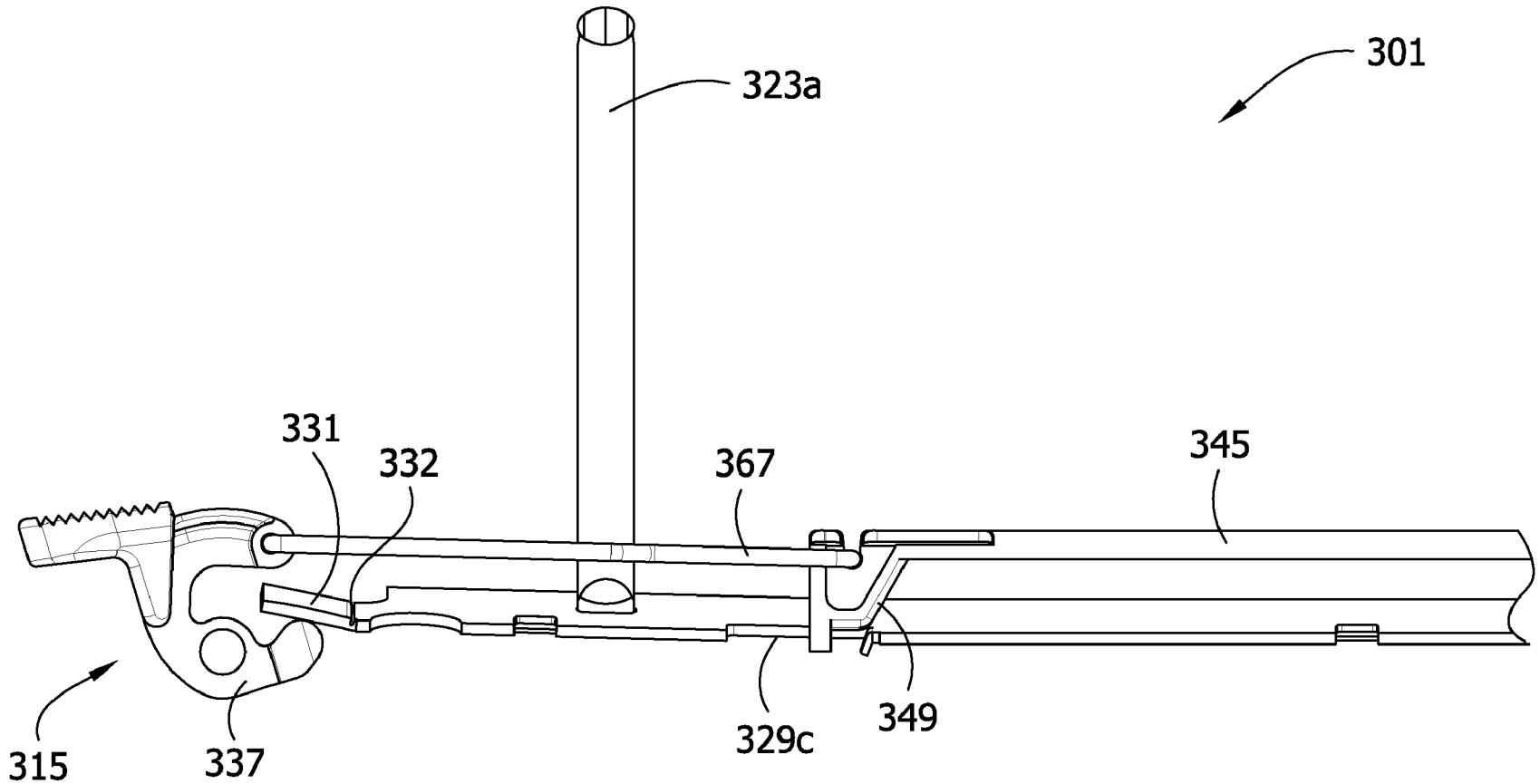
FIG. 28 is a side view of the mechanism with the housing removed showing the mechanism in an intermediate position.
Figure 29:
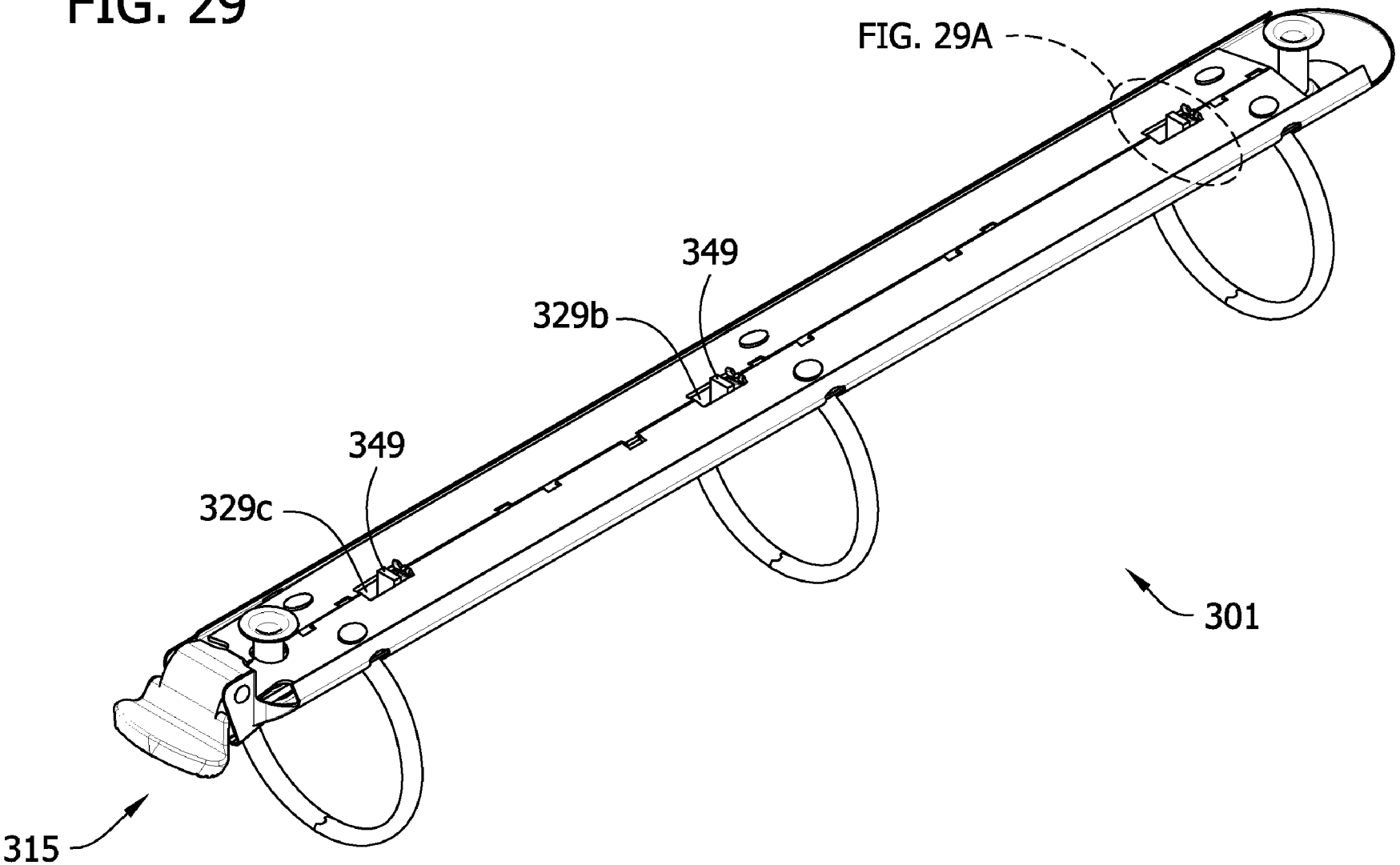
FIG. 29 is a bottom perspective view of the ring mechanism at the intermediate position.
Figure 29A:
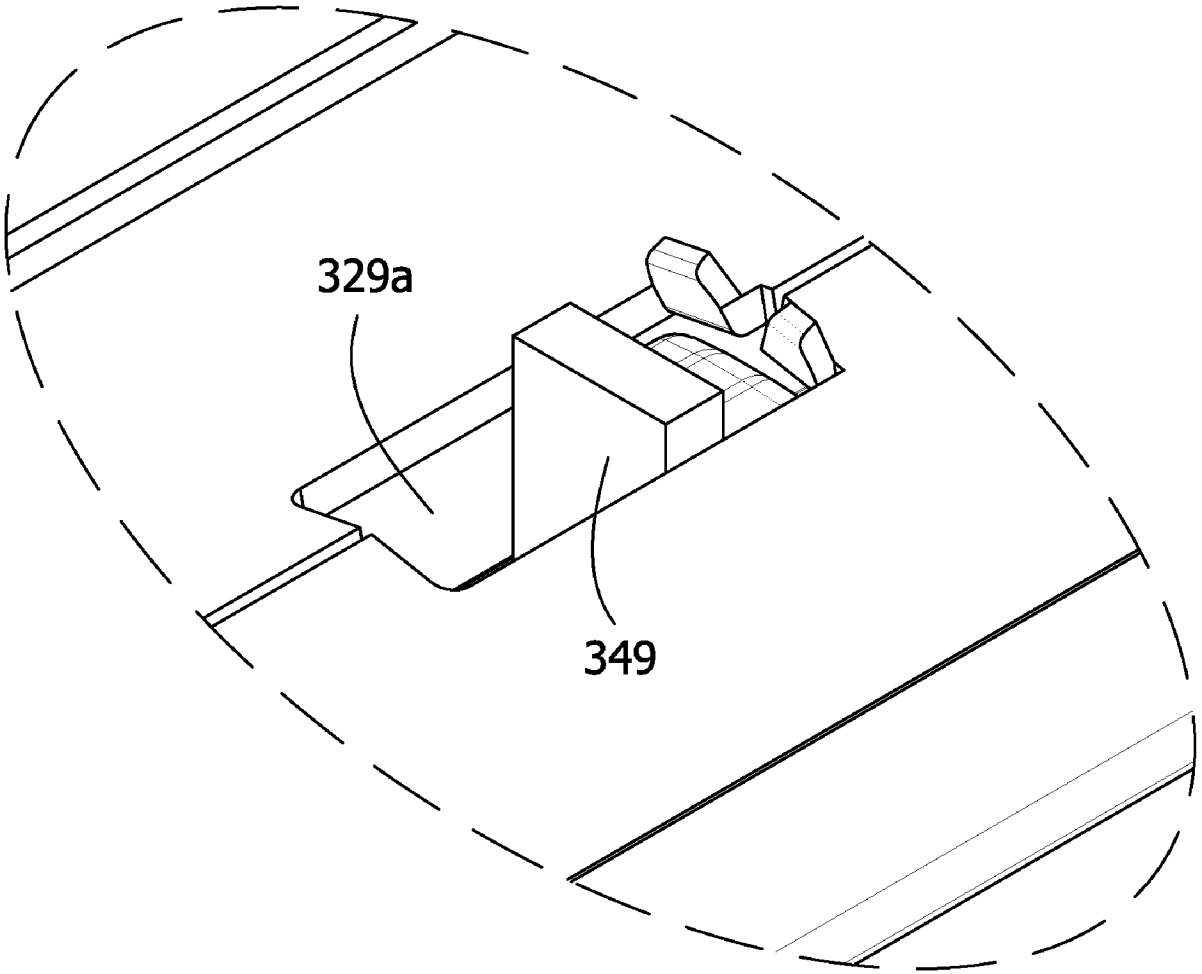
FIG. 29A is an enlarged view of the circled portion in FIG. 29.

Operation of the ring mechanism 301 will be described with reference to the enlarged fragmentary views of FIGS. 25-31. In FIGS. 25-27, the ring mechanism 301 is in the closed and locked position. To unlock the ring mechanism 301 and open the ring members 323*a*, 323*b*, an operator pivots the lever 315 outward and downward (counter-clockwise as viewed in FIGS. 25 and 26) such that the tongue 337 of the lever 315 presses upward against the fingers 331. The spring force of the housing 311 holds most of the length of the hinge plates 327*a* and 327*b* essentially stationary and unflexed, but as best shown in FIG. 28, the channels 332 (i.e., the lines of weakness) formed in the hinge plates at the base of the fingers 331 allow the fingers 331 to bend or flex upward relative to the remaining longitudinal extent (i.e., the main portion) of the hinge plates, and in particular to bend or flex along the lines of weakness) as the tongue 337 presses upward on the fingers 331. This flexing of the fingers 331 enables the lever 315 to continue rotating, which, via the intermediate connector 367, pulls the travel bar 345 from the locked position (FIGS. 25-27) to an intermediate position (FIGS. 28, 29, and 29A) in which the locking elements 349 come into registration with the cutouts 329*a-c*. Thus, this configuration/mechanism reduces binding of the bottoms of the locking elements 349 against the upper surfaces of the hinge plates and helps the travel bar 345 move from the locked position to the intermediate position.

Figure 30:
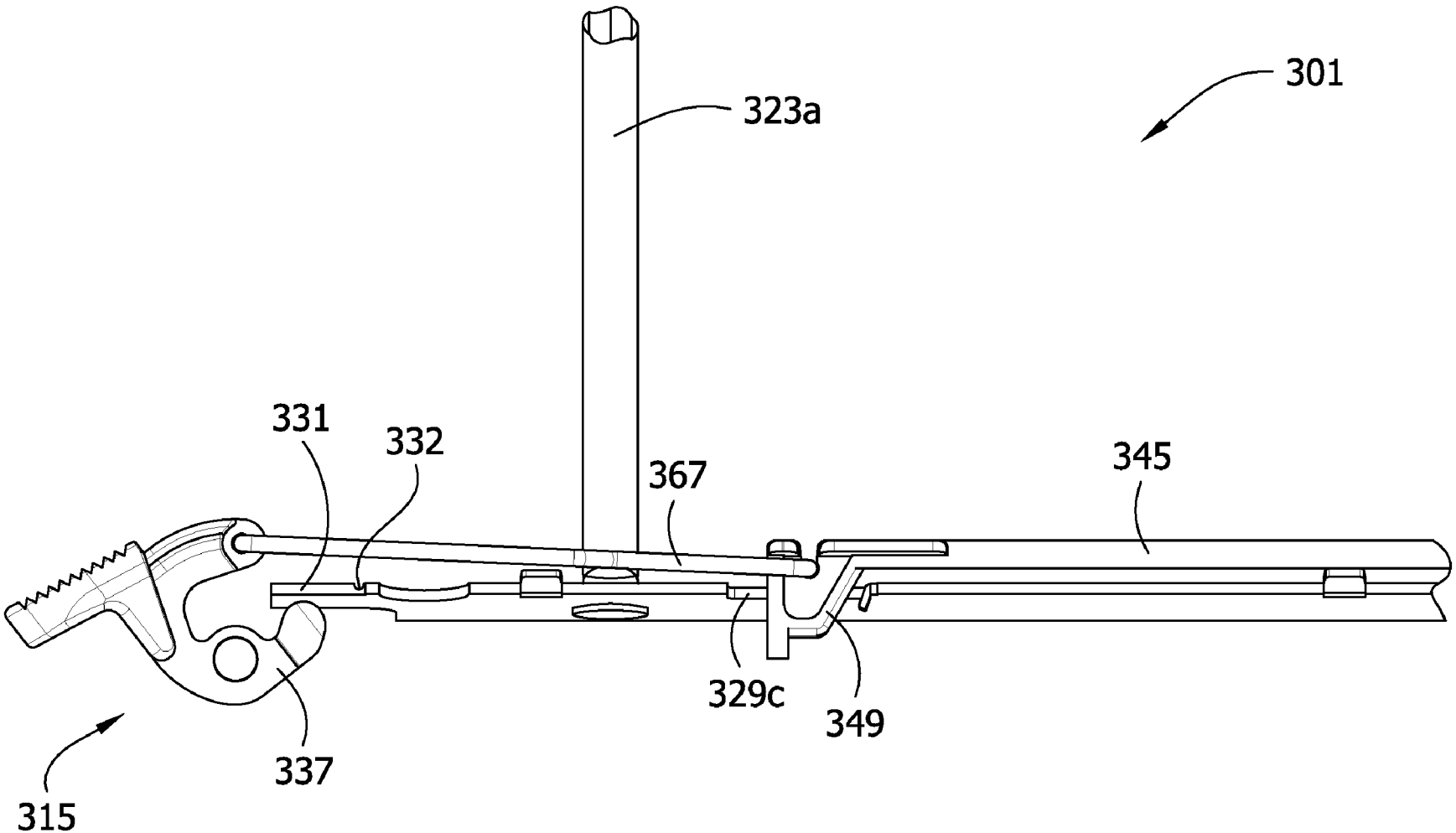
FIG. 30 is side view of the mechanism with the housing removed showing the mechanism in an open, unlocked position.
Figure 31:
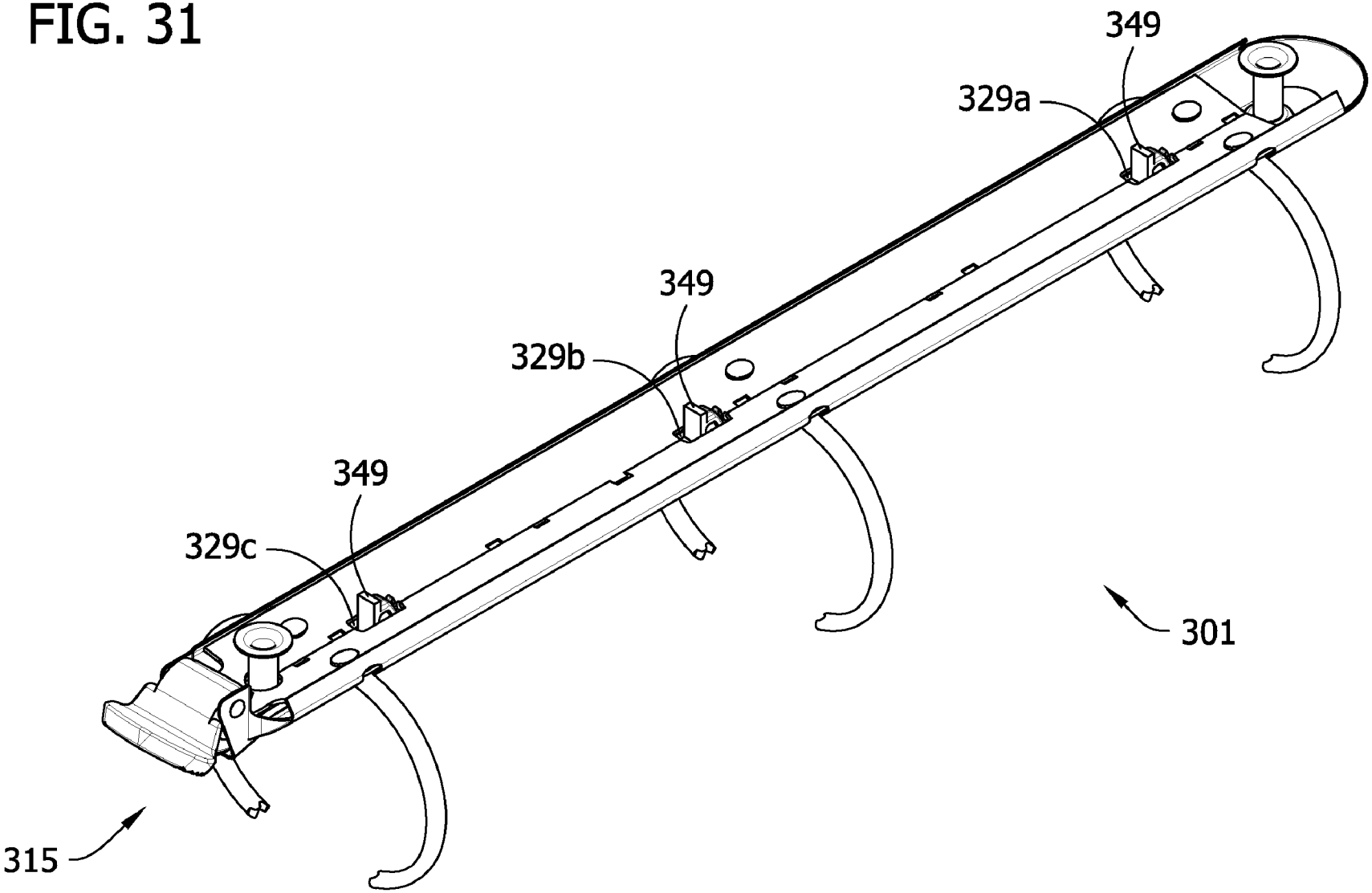
FIG. 31 is a bottom perspective view of the ring mechanism at the open, unlocked position.
Figure 32:
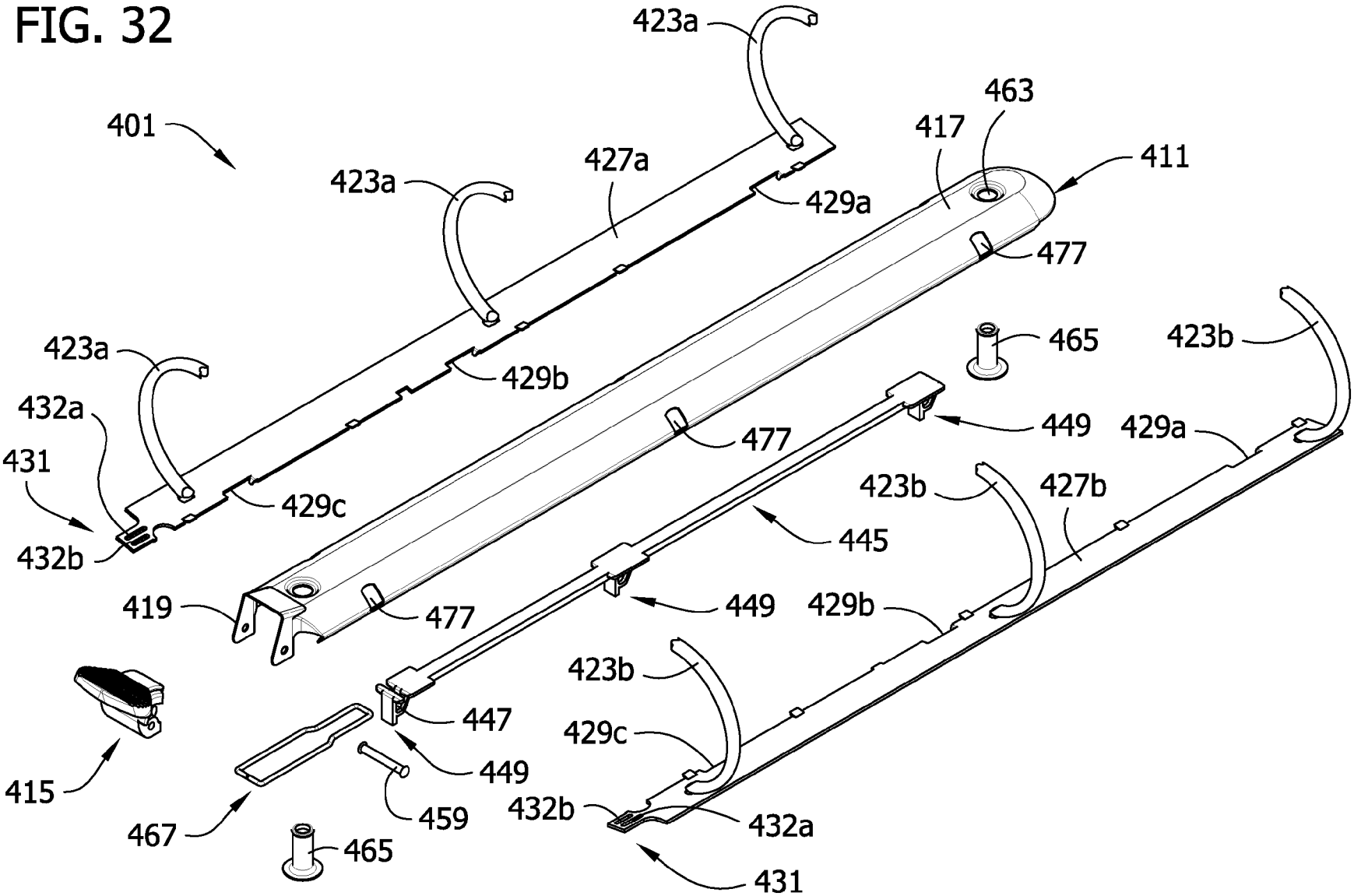
FIG. 32 is an exploded perspective of a ring mechanism according to a fifth embodiment.
Figure 33:
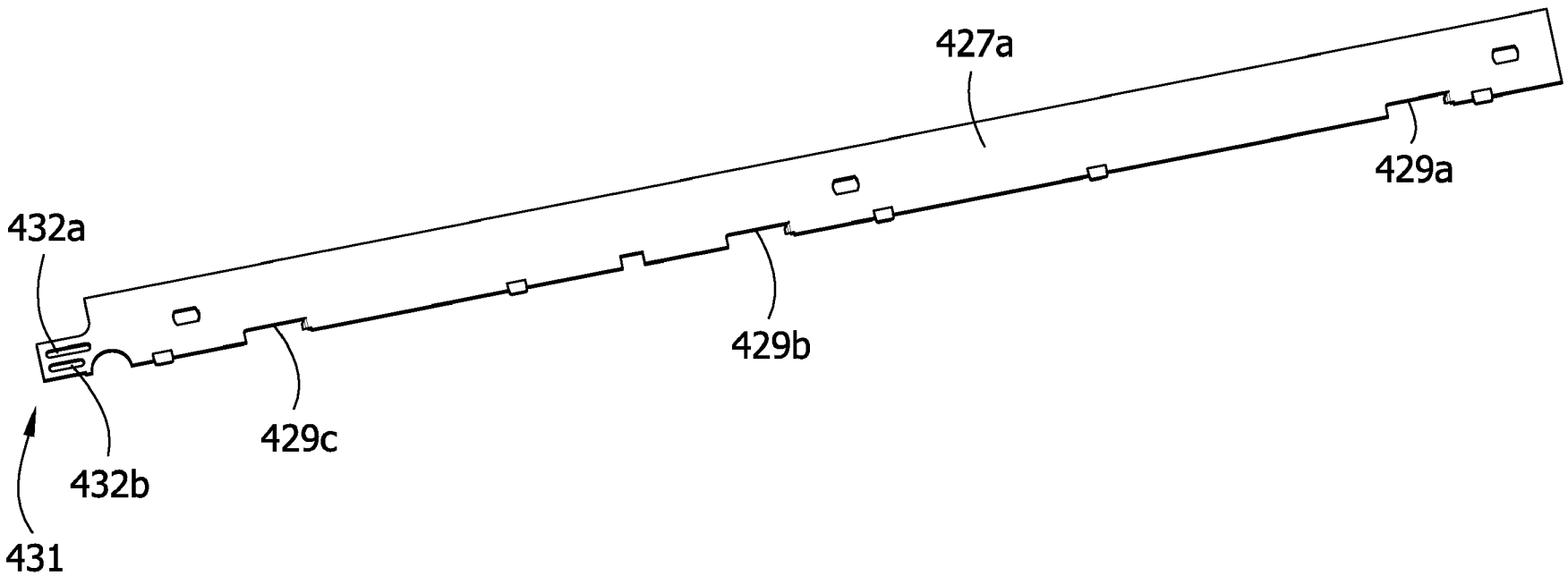
FIG. 33 is a side perspective of a hinge plate used therein.
Figure 34:
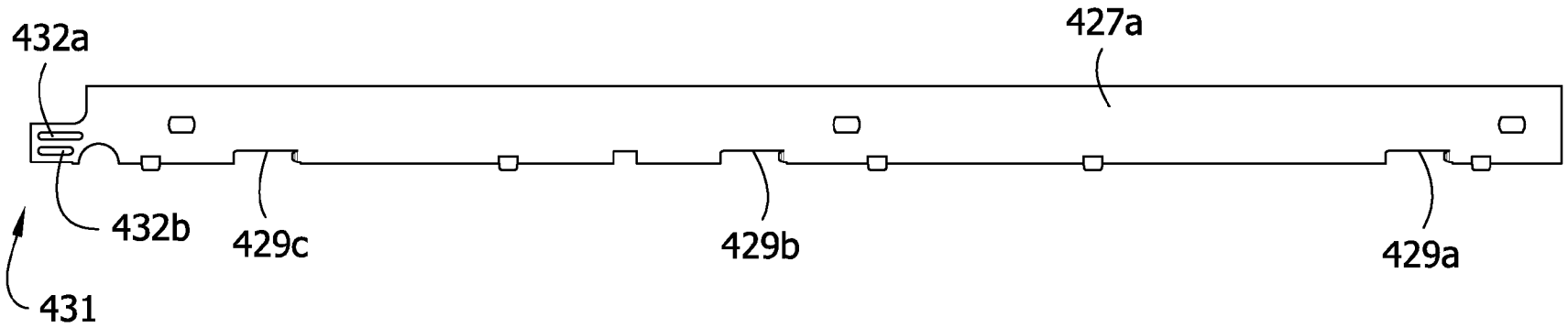
FIG. 34 is a plan view of the hinge plate shown in FIG. 33.

Once the locking elements 349 move into registration with the locking element openings 329*a-c*, the hinge plates are free to pivot upwardly through their co-planar position to open the ring members 323*a*, 323*b* under the influence of continued pressure on the lever 315. The tension in the hinge plates 327*a*, 327*b* dissipates and the lever 315 can be released, and the spring force of the housing 311 holds the hinge plates hinged upward. As shown in FIGS. 30 and 31, the locking elements 349 are at rest within the respective hinge plate cutout openings 229*a-c*, free of any forces tending to move them to the locked position.

As in the ring mechanism 201 of FIGS. 17-21, to close the ring members 323*a*, 323*b* of this ring mechanism 301 and return the ring mechanism to the locked position, an operator manually pushes the free ends of the ring members together. The hinge plates 327*a*, 327*b* pivot downward and cause the lever 315 to rotate clockwise (as viewed in FIG. 30). The locking elements 349 resist movement of the lever 315, and thus downward movement of the hinge plates 327*a*, 327*b*, causing the fingers 331 to flex relative to the remaining longitudinal extent of the hinge plates. The hinge plates 327*a*, 327*b* bend down while the lever 315 and fingers 331 remain relatively stationary. The angled sides of the locking elements 349 allow the locking elements to move small amounts away from the lever 315 as the hinge plates 327*a*, 327*b* bend, allowing the lever to pivot slightly. Once the hinge plates 327*a*, 327*b* clear the bottoms of the locking elements 349, the tension in the flexed hinge plates immediately pivots the lever 315 to its vertical position, pushing the travel bar 345 and locking elements 349 to the locked position.

In this ring mechanism 301, the unique cooperation between the lever 315, the hinge plates 327*a*, 327*b*, and the locking elements 349 allows the mechanism to operate between the closed and locked position and the open position. When opening the ring members 323*a*, 323*b*, the fingers 331 on the hinge plates 327*a*, 327*b* briefly flex upward to allow the lever 315 to pivot to move the locking elements 349 into registration with the locking element openings 329*a-c* of the hinge plates. The lever 315, together with the tension from the flexed hinge plate fingers 331 and the spring force of the housing 311, then pivot the hinge plates over the locking elements 349 to open the ring members 323*a*, 323*b*. When closing the ring members 323*a*, 323*b*, the fingers 331 again flex to allow the hinge plates to pivot downward over the locking elements 349.

In the illustrated embodiment of FIGS. 22-31, the channel 332 defining the line of weakness extends transversely across the width of the finger 331. However, it is understood that the channel 332 may extend transversely across less than the entire width of the finger 331 without departing from the scope of this invention. It is also contemplated that the channel 332 may extend across all or part of the width of the each hinge plate other than at the fingers 331, such as longitudinally beyond the fingers 332. Also, while the line of weakness in the illustrated embodiment is in the form of a channel 332 formed partially through the thickness of the hinge plate 327*a*, 327*b*, it is contemplated that the transverse line of weakness may comprise one or more transversely extending slots that are formed through the entire thickness of the hinge plate, or a series of openings (e.g., perforations) formed along a transverse line across all or part of the width of the hinge plate, or other suitable elements formed in the hinge plates that weaken the resistance of the hinge plate against bending generally at the line of weakness.

Figure 35:
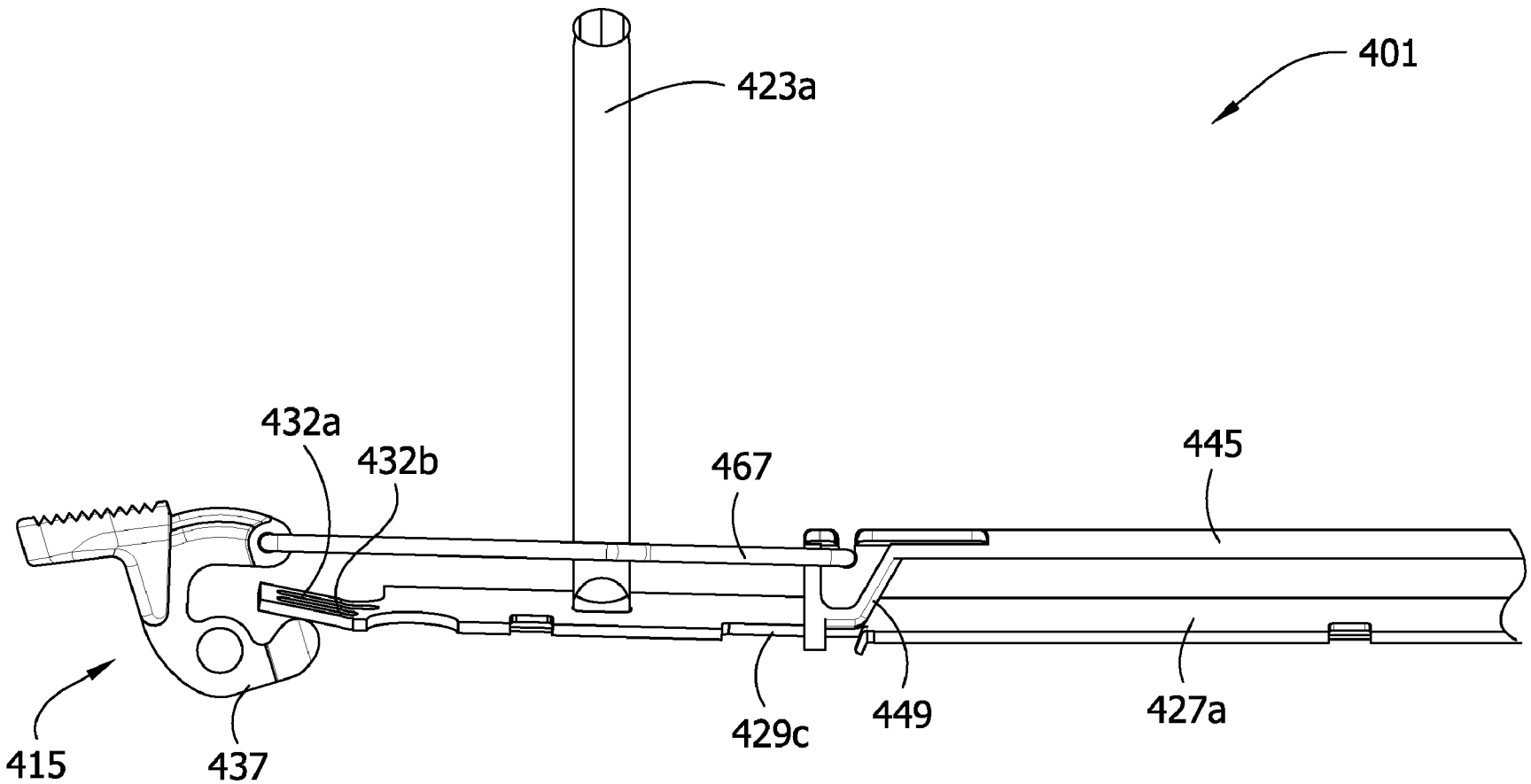
FIG. 35 is a side view of the mechanism with the housing remove showing the mechanism in an intermediate position.

FIGS. 32-35 show a fifth embodiment of a ring mechanism generally indicated at 401 and similar to the ring mechanism 301 of FIGS. 22-31 but with a line of weakness present in the hinge plates 427*a*, 427*b* proximate the free ends thereof (e.g., at the fingers 431) in the form of one or more longitudinally extending slots (a pair of slots 432*a*, 432*b* are illustrated in hinge plate of the embodiment of FIGS. 32-35) that extend through the thickness of the hinge plates. These longitudinally extending slots 432*a*, 432*b* decrease the bending stiffness (i.e., the resistance to bending) of the hinge plates 427*a*, 427*b*, such as at the fingers 431. Opening and closing operation of the fifth embodiment 401, which is illustrated in an intermediate position in FIG. 35, is substantially identical to that of the fourth embodiment 301 except that bending of the fingers 431 relative to the remaining longitudinal extent of the hinge plates 427*a*, 427*b* does not occur along the line of weakness. Rather, the bending occurs transverse to the line of weakness due to the material removed or omitted across the width of the hinge plates 427*a*, 427*b* at the fingers to form the slots 432*a*, 432*b*.

It is understood that more or less than two longitudinally extending slots 432*a*, 432*b* may be formed in the hinge plates 427*a*, 427*b* without departing from the scope of this invention. Also, while the slots 432*a*, 432*b* of the illustrated embodiment are of different lengths, it is contemplated that the slots may be of the same length. It is also contemplated that one or more of the slots 432*a*, 432*b* may extend longitudinally further from the finger 431 into the remaining longitudinal extent of the hinge plates 427*a*, 427*b* and remain within the scope of this invention. Instead of slots that extend through the thickness of the hinge plates 427*a*, 427*b* at the fingers 431, the line of weakness may be formed by openings (e.g., perforations) formed in a longitudinally linear pattern, longitudinally extending channels formed in the hinge plates that extend through less than the entire thickness of the hinge plates, or other suitable weakening elements formed in the hinge plates.

FIGS. 36-40 show a sixth embodiment of a ring mechanism 501 substantially similar to the ring mechanisms 301, 401 of the fourth and fifth embodiments described above but with a different hinge plate 527*a*, 527*b* and finger 531 construction to facilitate bending of the hinge plate, and more particularly bending of the finger relative to the main portion of the hinge plate. Also in this sixth embodiment, the lever 515 (which includes a separate finger pad 516 mounted thereon) is pivotally attached to the housing 511 via pivot pin 559 passing through eyelets 519, which extend above the plateau 517 (instead of below the plateau as in the previous embodiments). The intermediate connector 567 is connected to the lever 515 via drop-down arms 568 at connection point 570 (FIG. 38), which is located below the pivot connection of the lever 515 to the housing 511.

Figure 38:
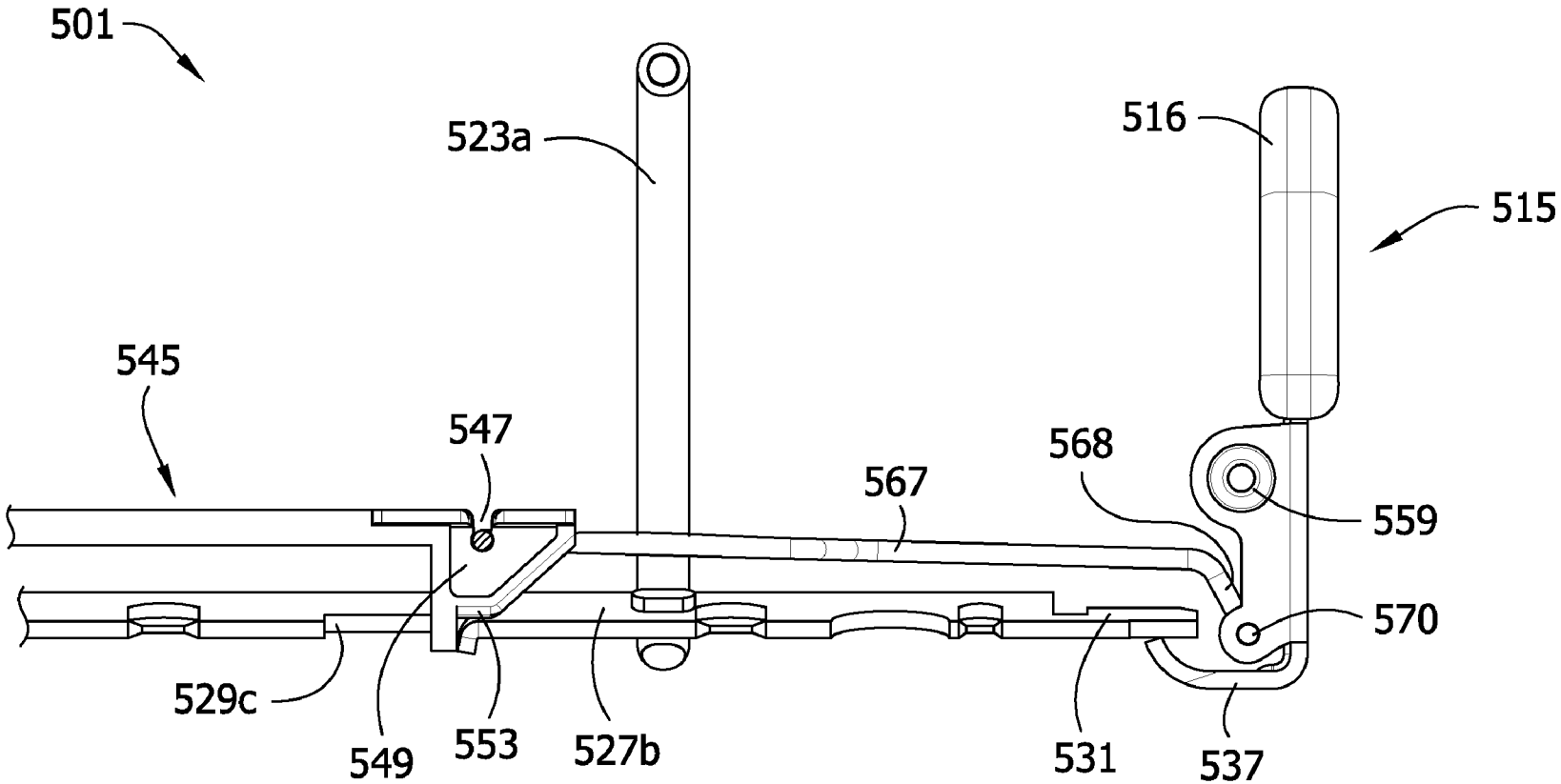
FIG. 38 is a fragmentary side view of the ring mechanism shown in FIG. 36, showing it in the closed and locked position.
Figure 39:
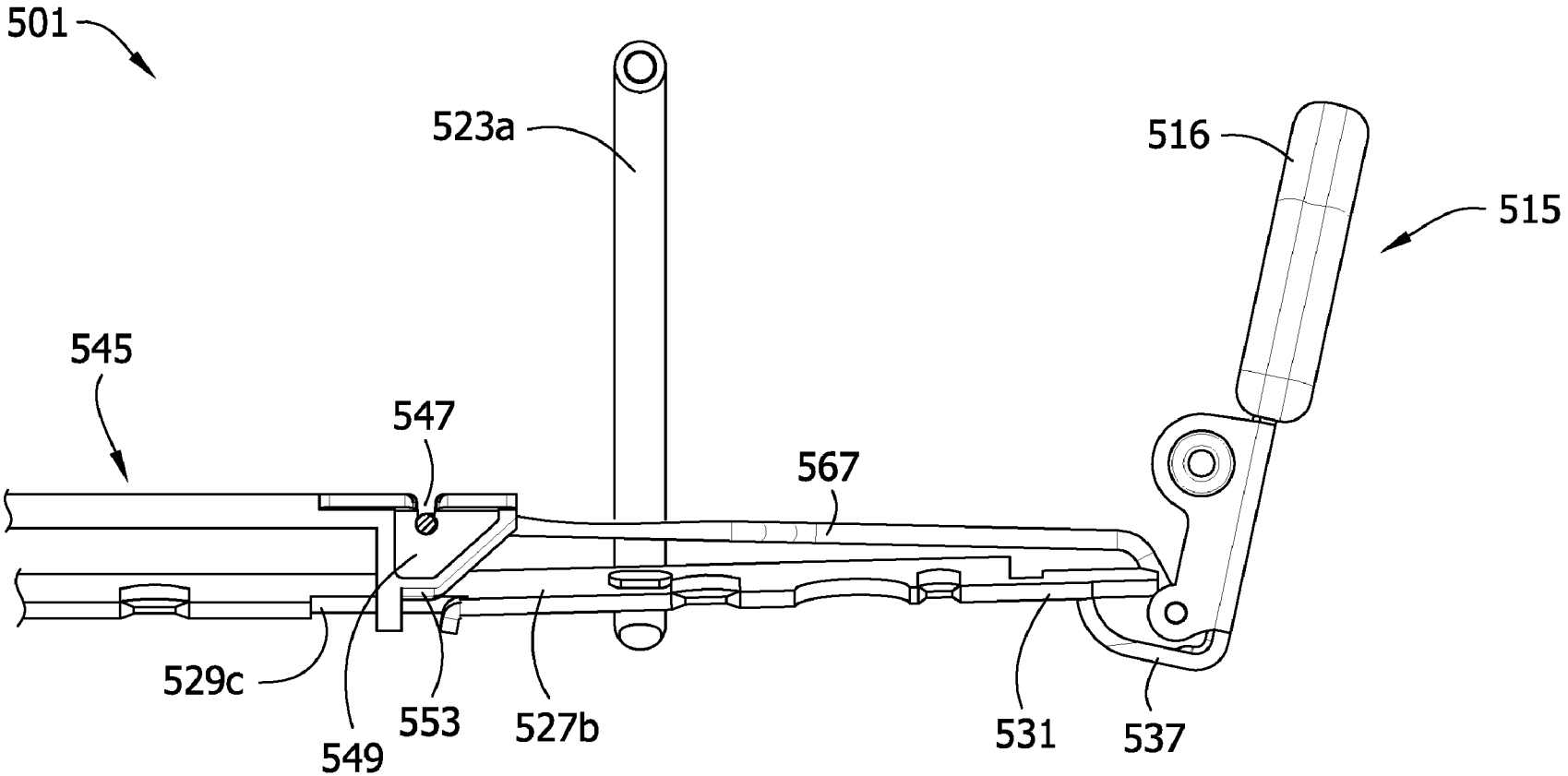
FIG. 39 is a fragmentary side view of the ring mechanism shown in FIG. 36, showing it in an intermediate position during the opening process.
Figure 40:
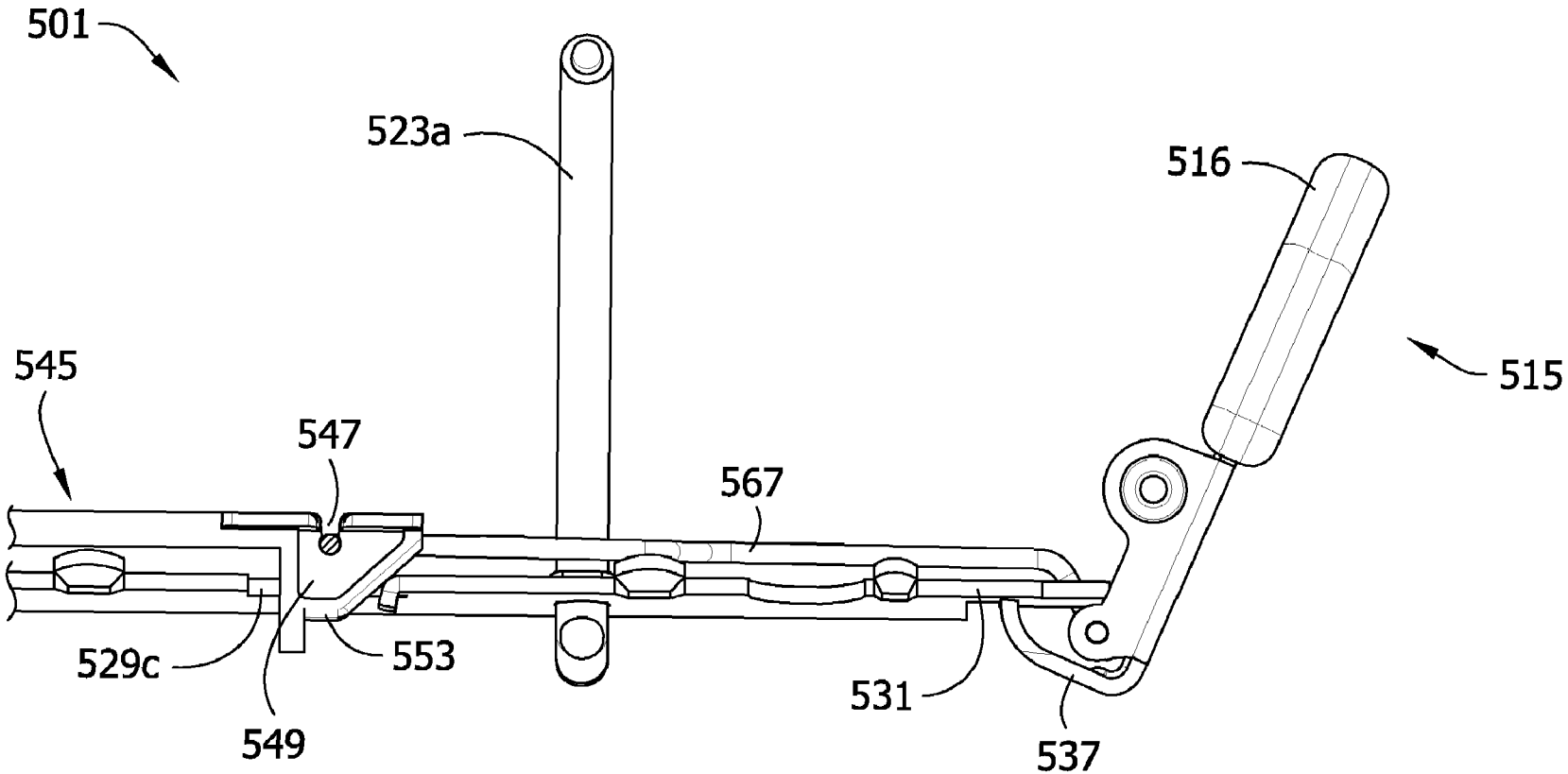
FIG. 40 is a fragmentary side view of the ring mechanism shown in FIG. 36, showing it in the open and unlocked position.

As a result of the relative positioning of the lever pivot point and the intermediate connector connection point 570, the intermediate connector 567 is pushed away from the lever 515 (i.e., to the left in FIGS. 38-40) when the lever 515 is pivoted outwardly (i.e., clockwise as shown in FIGS. 38-40). Accordingly, the travel bar 545—to which the intermediate connector 567 is connected at notch 547 formed in the locking element 549 that is closest to the lever 515—is pushed away from the lever 515 when the lever 515 is pivoted outward. This is in contrast to the embodiments described above, in which the relative positioning of the lever pivot points and intermediate connector connection points (i.e., to the lever) is such that the intermediate connector, and hence the travel bar, is pulled toward the lever when the lever is pivoted outward.

Figure 36:
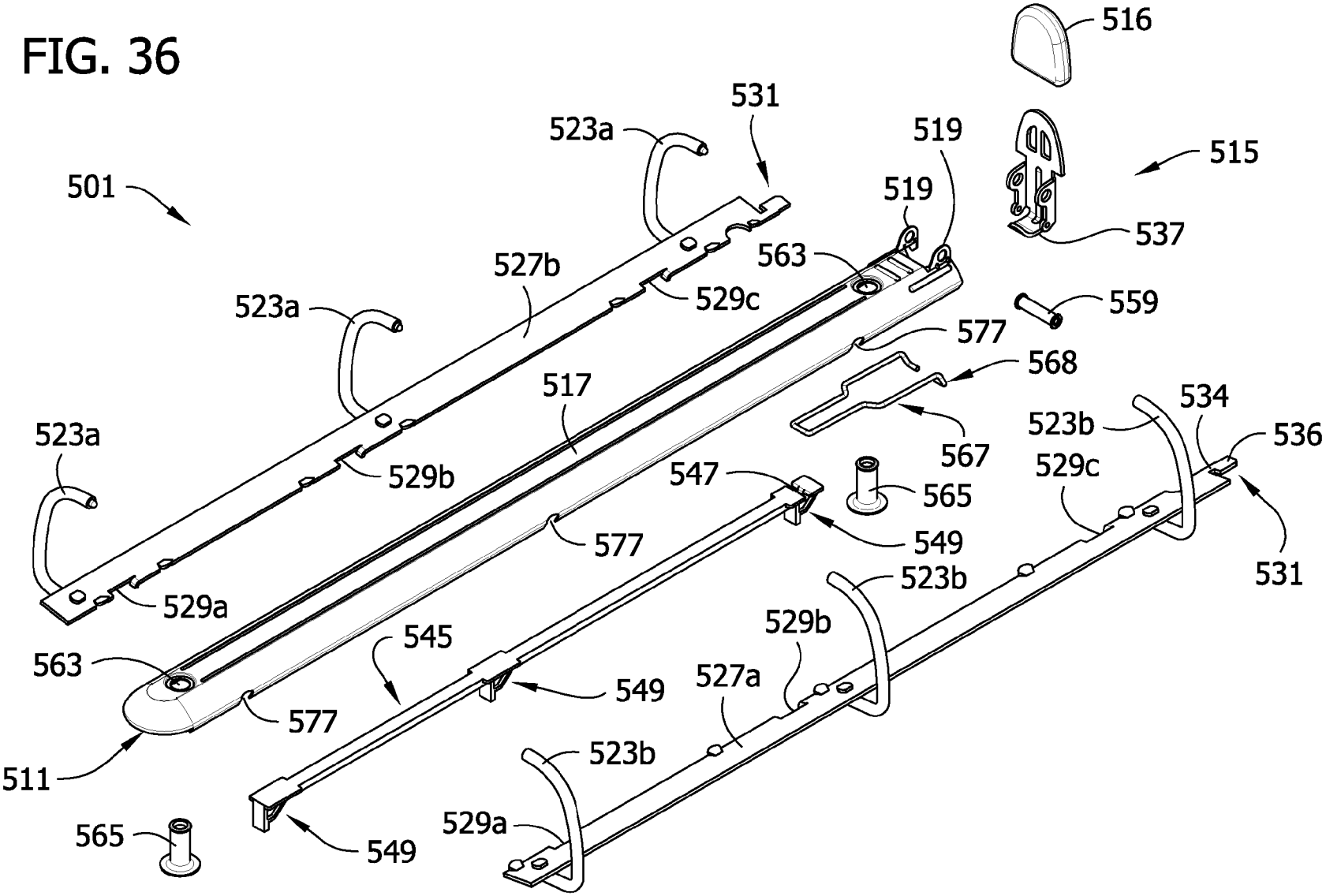
FIG. 36 is an exploded perspective of a ring mechanism according to a sixth embodiment.
Figure 37:
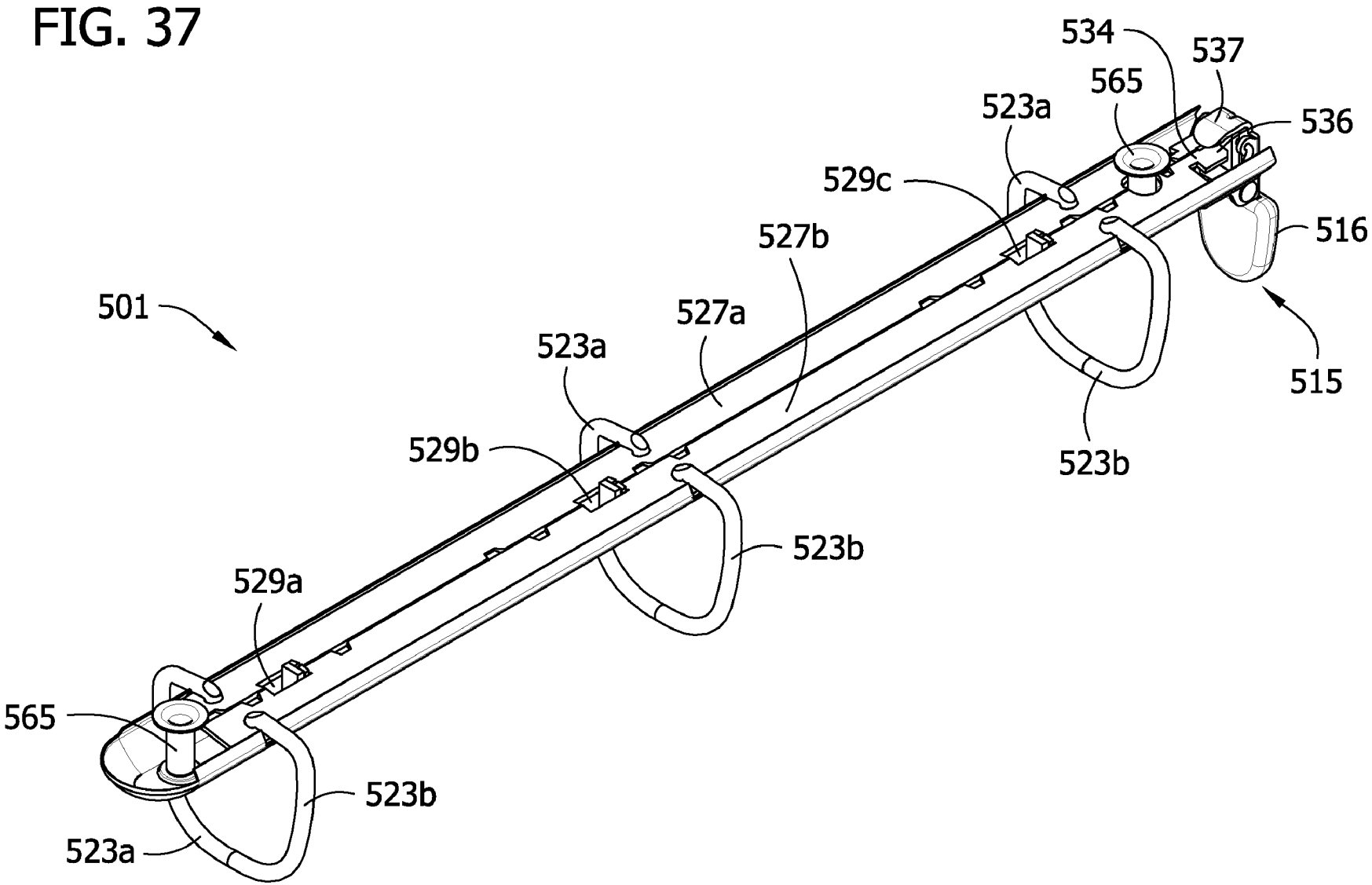
FIG. 37 is a bottom perspective of the ring mechanism shown in FIG. 36.

As best shown in FIGS. 36 and 37, the fingers 531 extending from the hinge plates 527*a*, 527*b* each have a narrow, necked-down portion 534 (e.g., having a second width that is narrower than the width, or a first width, of the main portion of the hinge plate) and an enlarged, tabular head portion 536 (e.g., having a third width greater than the second width of the necked-down portion of the finger). In particular, the necked down portions 534 are formed by generally square or rectangular cut-outs in the fingers 531. These necked down portions 534 decrease the bending stiffness (i.e., the resistance to bending) of the fingers 531 relative to the remaining longitudinal extent of the hinge plates 527*a*, 527*b*, while the head portions 536 provide ample bearing surfaces against which the tongue 537 of the lever 515 can press to open the ring mechanism 501.

Operation of the ring binder mechanism 501 is otherwise generally the same as operation of the embodiments 301 and 401 described above. In particular, the ring binder mechanism is shown in the closed position in FIG. 38. In that position, the lever 515 is in an upright position, and bottom surfaces 553 of the locking elements 549 are positioned above the upper surfaces of the hinge plates 527*a*, 527*b* so as to block opening movement of the hinge plates 527*a*, 527*b*.

As the lever 515 is pivoted outwardly (i.e., counterclockwise as shown in FIGS. 38-40) and the lever tongue 537 bears against the fingers 531, the position of the locking elements 549 initially prevents the hinge plates 527*a*, 527*b* from pivoting. However, the increased flexibility of the fingers 531 relative to the main body portions of the hinge plates 527*a*, 527*b*, attributable to the necked-down portions 534 of the fingers 531, allows the fingers 531 to bend upward as shown in FIG. 39. That upward bending of the fingers 531 relative to the rest of the hinge plates allows the lever 515 to push the travel bar 545 away from it (i.e., to the left as shown in FIGS. 38-40), such that the locking elements 549 come into registration with the hinge plate cutouts 529*a-c* (only one of which is shown), as shown in FIG. 39. Once the locking elements 549 come into registration with the hinge plate cutouts 529*a-c*, tension in the hinge plates 527*a*, 527*b* is sufficient to overcome the spring force of the housing 511, and the hinge plates pivot upwardly over the locking elements 549, into the open position shown in FIG. 40. At that point, tension in the hinge plates 527*a*, 527*b* dissipates, and the fingers 531 relax relative to the main body portions of the hinge plates 527*a*, 527*b*.

Components of ring binder mechanisms of the embodiments described and illustrated herein are made of a suitable rigid material, such as a metal (e.g. steel). But mechanisms having components made of a nonmetallic material, specifically including a plastic, do not depart from the scope of this invention.

When introducing elements of the various ring mechanisms herein, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for holding loose-leaf pages, the mechanism comprising:

a housing;

at least one ring for holding the loose-leaf pages, said ring comprising a first ring member and a second ring member, said ring members being configurable between a closed position and an open position, in the closed position the ring members forming a substantially continuous closed loop for allowing loose-leaf pages retained by said ring to be moved along said ring from one ring member to the other, and in the open position the two ring members form a discontinuous, open loop for adding or removing loose-leaf pages from said ring;

a hinge mechanism operatively connected to the ring members for configuring said ring members between their open and closed positions, said hinge mechanism comprising a pair of elongate hinge plates supported within the housing for pivoting movement relative to the housing between a first hinge plate position corresponding to the closed position of the ring members and a second hinge plate position corresponding to the open position of the ring members, each of said hinge plates having a free end and a line of weakness formed therein proximate the free end to facilitate bending of the hinge plate; and an actuator moveable between a first position corresponding to the closed position of the ring members and a second position corresponding to the open position of the ring members, the actuator comprising an opening arm and a bearing surface on the opening arm engageable with the hinge plates proximate the free ends thereof upon movement of the actuator from its first position toward its second position such that the hinge plates bend proximate their free ends to delay pivoting movement of the hinge plates upon initial movement of the actuator from its first position toward its second position;

the line of weakness being spaced longitudinally inward from the bearing surface of the opening arm of the actuator when the bearing surface engages the hinge plates to open the ring.

2. The ring mechanism set forth in claim 1 wherein each hinge plate has a width, the line of weakness extending transversely across at least a portion of the width of the hinge plate.

3. The ring mechanism set forth in claim 2 wherein the line of weakness extends transversely across the entire width of the hinge plate.

4. The ring mechanism set forth in claim 1 wherein each hinge plate has a thickness, the line of weakness extending through at least a portion of the thickness of the hinge plate.

5. The ring mechanism set forth in claim 4 wherein the line of weakness comprises an elongate channel formed in the hinge plate through a portion of the thickness of the hinge plate and not extending through the entire thickness of the hinge plate.

6. The ring mechanism set forth in claim 4 wherein the line of weakness comprises at least one opening formed through the entire thickness of the hinge plate.

7. The ring mechanism set forth in claim 6 wherein the line of weakness comprises at least one elongate slot formed through the entire thickness of the hinge plate.

8. The ring mechanism set forth in claim 7 wherein the line of weakness comprises a plurality of elongate slots formed through the entire thickness of the hinge plate.

9. The ring mechanism set forth in claim 1 wherein the line of weakness extends longitudinally of the hinge plate.

10. The ring mechanism set forth in claim 9 wherein the line of weakness comprises an elongate slot extending longitudinally of the hinge plate proximate the free end thereof.

11. The ring mechanism set forth in claim 10 wherein a plurality of longitudinally extending elongate slots are formed in the hinge plate proximate the free end thereof.

12. The ring mechanism set forth in claim 11 wherein the slots all have substantially the same length.

13. The ring mechanism set forth in claim 1 wherein the line of weakness is located and configured in the hinge plate to facilitate bending of the hinge plate along said line of weakness.

14. The ring mechanism set forth in claim 1 further comprising a locking system operatively connected to the actuator for conjoint movement with the actuator between a locked position corresponding to the first position of the actuator to lock the ring members in their closed position, and an unlocked position in which the ring members are configurable from their closed position to their open position, said locking system being positionable by the actuator from its locked position to its unlocked position during bending of the hinge plates upon initial movement of the actuator from its first position toward its second position.

15. The ring mechanism as set forth in claim 14 wherein the locking system comprises a travel bar including a locking element, the travel bar being moveable by the actuator between a locking position and a non-locking position.

16. The ring mechanism set forth in claim 1 wherein the hinge plates each comprise a main portion and a finger extending longitudinally from the main portion to a longitudinal end of the finger that defines the free end of the hinge plate, said free end being narrower than the main portion of the hinge plate, the line of weakness being formed in said finger to facilitate bending of the finger relative to the main portion of the hinge plate.

17. A ring mechanism for holding loose-leaf pages, the ring mechanism comprising:

a housing;

at least one ring for holding the loose-leaf pages, said ring comprising a first ring member and a second ring member, said ring members being configurable between a closed position and an open position, in the closed position the ring members forming a substantially continuous closed loop for allowing loose-leaf pages retained by said ring to be moved along said ring from one ring member to the other, and in the open position the two ring members form a discontinuous, open loop for adding or removing loose-leaf pages from said ring;

a hinge mechanism operatively connected to the ring members for configuring said ring members between their open and closed positions, said hinge mechanism comprising a pair of elongate hinge plates supported within the housing for pivoting movement relative to the housing between a first hinge plate position corresponding to the closed position of the ring members and a second hinge plate position corresponding to the open position of the ring members, each of said hinge plates having a free end and being configured to have a first width, a second width narrower than the first width and nearer to the free end of the hinge plate than said first width, and a third width greater than said second width and nearer to the free end of the hinge plate than said second width to facilitate bending of the hinge plate generally at said second width; and an actuator moveable between a first position corresponding to the closed position of the ring members and a second position corresponding to the open position of the ring members, the actuator comprising an opening arm and a bearing surface on the opening arm engageable with the hinge plates proximate the free ends thereof upon movement of the actuator from its first position toward its second position such that the hinge plates bend proximate their free ends generally at said second width to delay pivoting movement of the hinge plates upon initial movement of the actuator from its first position toward its second position;

the second width being spaced longitudinally inward from the bearing surface of the opening arm of the actuator when the bearing surface engages the hinge plates to open the ring.

18. The ring mechanism set forth in claim 17 further comprising a locking system operatively connected to the actuator for conjoint movement with the actuator between a locked position corresponding to the first position of the actuator to lock the ring members in their closed position, and an unlocked position in which the ring members are configurable from their closed position to their open position, said locking system being positionable by the actuator from its locked position to its unlocked position during bending of the hinge plates upon initial movement of the actuator from its first position toward its second position.

19. The ring mechanism as set forth in claim 18 wherein the locking system comprises a travel bar including a locking element, the travel bar being moveable by the actuator between a locking position and a non-locking position.

20. The ring mechanism set forth in claim 17 wherein the hinge plates each comprise a main portion and a finger extending longitudinally from the main portion of the hinge plate to a longitudinal end of the finger that defines the free end of the hinge plate, said finger having a base and a longitudinal end spaced from said base and defining the free end of the hinge plate, the finger being narrower at its base than at its longitudinal end to facilitate bending of the finger generally at its base.

21. The ring mechanism set forth in claim 20 wherein the finger has a length, said finger being narrower than the main portion of the hinge along the entire length of said finger.

* * * * *